US007421847B2

(12) United States Patent
Murray et al.

(10) Patent No.: US 7,421,847 B2
(45) Date of Patent: Sep. 9, 2008

(54) REFRIGERATION UNIT CONDENSATION PREVENTION

(75) Inventors: Brent W. Murray, Longmont, CO (US); Patrick M. Bertsch, Thornton, CO (US); Robert A. Majzner, Broomfield, CO (US)

(73) Assignee: Bradley W. Geuke, Ault, CO (US)

( * ) Notice: Subject to any disclaimer, the term of this patent is extended or adjusted under 35 U.S.C. 154(b) by 0 days.

(21) Appl. No.: 11/788,453

(22) Filed: Apr. 20, 2007

(65) Prior Publication Data

US 2007/0193294 A1 Aug. 23, 2007

Related U.S. Application Data

(62) Division of application No. 11/069,378, filed on Mar. 1, 2005, now Pat. No. 7,207,181.

(51) Int. Cl.
*A47F 3/04* (2006.01)

(52) U.S. Cl. ..... 62/80; 62/150; 62/176.6; 62/248

(58) Field of Classification Search ..... 62/80, 62/150, 176.2, 176.6, 248, 275
See application file for complete search history.

(56) References Cited

U.S. PATENT DOCUMENTS

| | | | |
|---|---|---|---|
| 3,939,666 | A | 2/1976 | Bashark |
| 4,127,765 | A | 11/1978 | Heaney |
| 4,261,179 | A | 4/1981 | Dageford |
| 4,862,701 | A | 9/1989 | Small et al. |
| 5,778,147 | A | 7/1998 | Kim |
| 5,778,689 | A | 7/1998 | Beatenbough |
| 5,899,078 | A | 5/1999 | Mager |
| 6,301,913 | B1 | 10/2001 | Schulak et al. |
| 6,470,696 | B1 | 10/2002 | Palfy et al. |
| 6,550,261 | B1 | 4/2003 | Shima et al. |
| 2004/0050072 | A1 | 3/2004 | Palfy et al. |

*Primary Examiner*—William E Tapolcai
(74) *Attorney, Agent, or Firm*—Harold A. Burdick

(57) ABSTRACT

Apparatus, systems and methods are disclosed for efficient elimination of door and frame condensation at widely utilized commercial freezer/refrigeration display cases. The apparatus includes a local controller unit connected with an array of case sensors including an internal case temperature sensor, an external case frame temperature sensor and a dew point sensor. The case frame temperature sensor and dew point sensor are housed to thermally isolate sensing elements thereof from effects of frame temperature changes and ambient air temperature in the vicinity of a sensing element, and to limit heat transfer by the housing to the sensing elements thereby improving sensing accuracy and apparatus performance.

20 Claims, 29 Drawing Sheets

Figure 15e
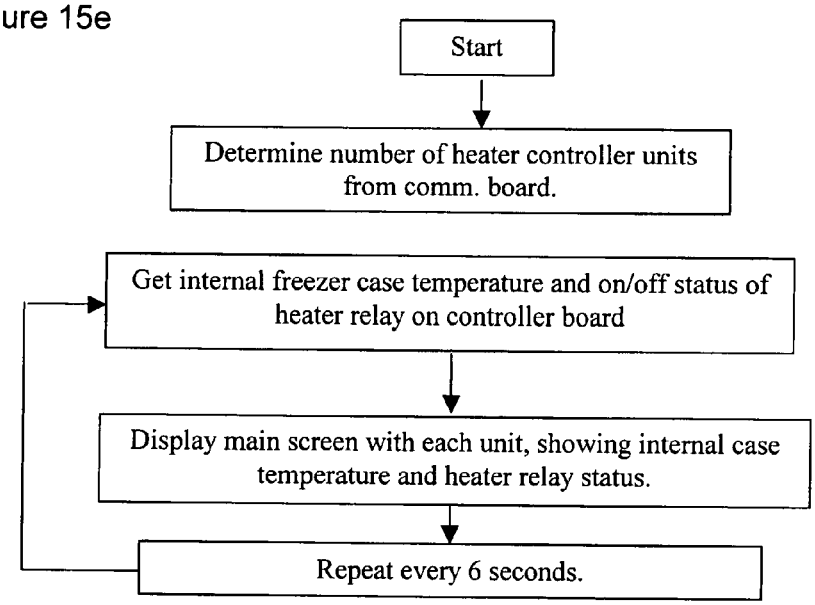
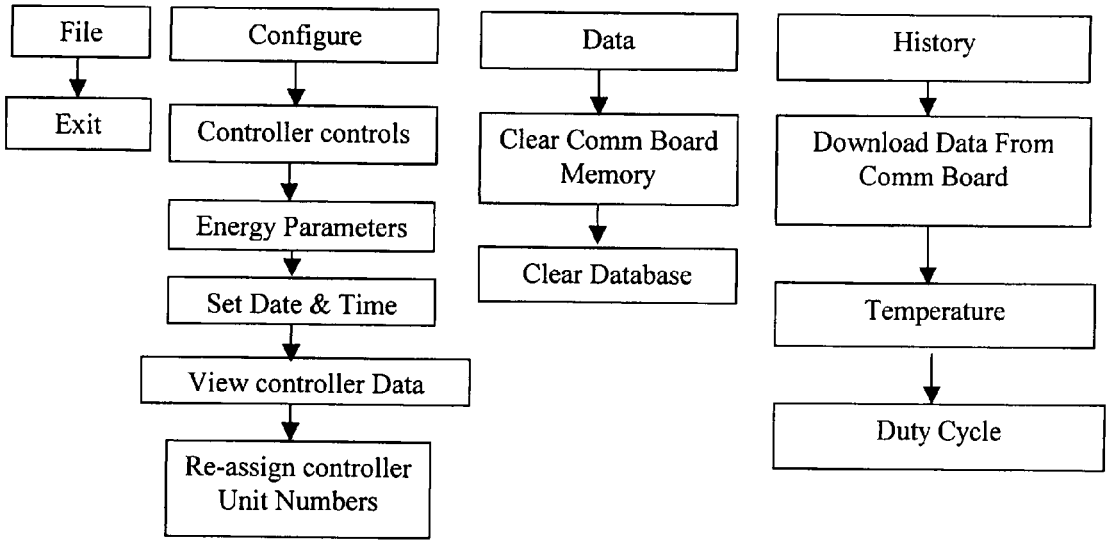
Figure 15f

REFRIGERATION UNIT CONDENSATION PREVENTION

RELATED APPLICATION

This application is a divisional application of U.S. patent application Ser. No. 11/069,378 Filed on Mar. 1, 2005 by Murray et al. and entitled "Refrigeration Unit Condensation Prevention" which will issue as U.S. Pat. No. 7,207,181 on Apr. 24, 2007.

FIELD OF THE INVENTION

This invention relates to frame and/or door heating to remediate condensation build-up in refrigerated display cases, and, more particularly, relates to sensing and operating devices and methods for activation and deactivation of such heating.

BACKGROUND OF THE INVENTION

Condensation build up on commercial refrigeration display case doors can cause door damage and presents a safety hazard if runoff from the door(s) and/or case frames accumulates on adjacent floors. Currently, in most commercial installations, in order to prevent excessive condensation build-up at display case doors and frames, the doors and frames are heated utilizing internal frame heaters operating at 100% duty cycle time (and incurring correspondingly high energy costs).

Devices have been heretofore suggested and/or utilized to control condensation without running heaters at 100% duty cycle times. One approach has utilized a detector to directly sense the presence of condensation on the freezer door or frame and, responsive thereto, activate the internal frame/door heaters when condensation is sensed. The heaters then are run for a fixed duration or until moisture has evaporated. These devices have, however, not always proven successful. For example, detector failure due to environmental contamination or poor manufacturing tolerances of moisture sensors in general is common. Such detector failure can result in either frame/door heaters remaining off (thus failing to inhibit dangerous condensation build-up and runoff) or the heaters remaining on (thereby achieving no energy savings). Moreover, such devices are merely reactive, activating heaters only after potentially damaging and dangerous condensation has formed. (see the DOOR MISER XP by Door Miser, LLC and U.S. Pat. No. 5,899,078, for examples).

Other devices have suggested condensation control utilizing dew point calculation. Monitoring air temperature, relative humidity and surface temperatures to initiate condensation control events has been utilized in a variety of applications including refrigeration (see, for example, U.S. Patent Publication No. US 2004/0050072 A1 and U.S. Pat. Nos. 6,470,696, 5,778,689, 5,778,147, and 4,127,765). Some such devices or systems have utilized temperature sensing of both cold surfaces and the surrounding ambient air in condensation control response calculations. As is known, when a cold surface temperature is equal to or lower than the dew point of the ambient air, condensation forms on the cold surface.

Such devices and systems have not proven altogether successful, however, due to inaccuracy of temperature readings, particularly where both cold and warm environments are adjacent one another such as is found at commercial freezer/refrigeration display cases. Failure to configure such systems to enhance accuracy of readings has resulted in erratic condensation control, on some occasions wasting energy unduly heating frames/doors, on other occasions responding late or otherwise inadequately to condensation formation, and/or on still other occasions failing to control appropriate heater cycling (i.e., shut-off) with consequent loss of efficiencies. Some such systems, utilized in fields not related to the problem of condensation at freezer doors, have addressed the problem of erratic temperature readings by artificially cooling the temperature sensors while heaters are powered on to counter the affect. This approach, however, is not feasible in large commercial freezer display installations where size and space are limited and where the cost for such counter measures are not easily absorbed (and not likely to be tolerated). Finally, most heretofore known systems employing dew point sensors for condensation control remain reactive, not proactively based on anticipation of condensation events. Further improvement could thus still be utilized

SUMMARY OF THE INVENTION

The purpose of the apparatus, systems and methods of this invention is to efficiently eliminate door and frame condensation at widely utilized commercial freezer/refrigeration display cases. The invention is proactive in preventing condensation from forming by activating frame/door heaters before the dew point temperature at frame and door surfaces is reached. Power is then cycled off at a set point above dew point to save energy. This is accomplished by configuring apparatus of this invention to provide highly accurate sensing of frame temperature and dew point by thermally isolating temperature sensors and constantly updating data to reliably provide the ability to accurately anticipate condensation at case surfaces. The invention eliminates door damage and runoff safety hazards due to condensation build-up, efficiently cycles duty time of frame/door heaters thus lowering the installation's energy costs, and requires no expensive countermeasures to maintain accuracy and efficacious performance.

The condensation control apparatus of this invention includes a frame temperature sensing unit adapted for monitoring temperature of either the door or case of a display case. The frame temperature sensing has temperature sensor mounted on a carrier. A dew point sensing unit is adapted for monitoring ambient air temperature and relative humidity outside of the display case and includes a carrier having at least one dew point sensing component thereat.

A control unit is connected with the sensing units and includes a processor connected for activating the display case frame/door heater when monitored display case door or frame temperature drops below a preselected set point above a dew point value derived from monitored ambient temperature and relative humidity. The processor also deactivates the frame/door heater when monitored display case door or frame temperature rises above a second preselected set point above the dew point value. Housing for locating the sensing units includes structure establishing thermal isolation of the sensing units by minimizing heat transfer contacts with the housing. The temperature sensor and the dew point sensing component are located amid insulating air pockets formed by the structure of the housing. The housing and control unit are mountable at the display case.

The system of this invention further includes the sensing and control apparatus located at each display case in an array of display cases. An internal case temperature sensing unit is positionable inside the display case and connected with the control unit processor. The processor stores data related to readings at the sensing units and operation of the frame/door heater, and a communication control unit associated with the processor enables coordination of programming and data download access to the processor.

The method of this invention is for condensation control at a refrigerated display case having at least one door, a frame and at least one frame/door heater. The steps of the method include placing a temperature sensing unit in contact with the display case frame to monitor case frame temperature and mounting a dew point sensing unit on the display case to monitor ambient air temperature and relative humidity outside the display case. The monitored case frame temperature, ambient air temperature and relative humidity are utilized to anticipate formation of condensation at the display case and activate and deactivate the frame/door heater responsive thereto.

It is therefore an object of this invention to provide apparatus, systems and methods for efficient elimination of door and frame condensation at widely utilized commercial freezer/refrigeration display cases.

It is another object of this invention to provide apparatus, systems and methods for elimination of door and frame condensation at freezer/refrigeration display cases that proactively prevents condensation from forming by activating frame/door heaters before dew point temperature at frame and door surfaces is reached.

It is still another object of this invention to provide apparatus for efficient elimination of door and frame condensation at freezer/refrigeration display cases that are configured to accurately sense frame temperature and dew point by thermally isolating temperature sensors and that are constantly data updated to reliably provide the ability to accurately anticipate condensation at case surfaces.

It is yet another object of this invention to provide apparatus, systems and methods utilized with freezer/refrigeration display cases that eliminate door damage and runoff safety hazards due to condensation build-up, efficiently cycle duty time of frame/door heaters thus lowering the installation's energy costs, and require no expensive countermeasures to maintain accuracy and performance of the apparatus and systems.

It is another object of this invention to provide condensation control apparatus for a refrigerated display case having at least one door, a frame and at least one frame/door heater, the apparatus including a frame temperature sensing unit adapted for monitoring temperature of one of the display case door or display case frame and including a carrier having a temperature sensor thereat, a dew point sensing unit adapted for monitoring ambient air temperature and relative humidity outside of the display case and including a carrier having at least one dew point sensing component thereat, a control unit connected with the sensing units and including processing means connected for activating the display case frame/door heater when monitored display case door or frame temperature drops below a preselected set point above a dew point value derived from monitored ambient temperature and relative humidity, and housing means for locating the sensing units including structure establishing thermal isolation of the sensing units by minimizing heat transfer contacts between the sensing units and the housing means and locating the temperature sensor and the at least one dew point sensing component amid insulating air pockets formed by the structure of the housing means.

It is still another object of this invention to provide a system for condensation control at an array of refrigerated display cases, the cases each having at least one door, a frame and at least one frame/door heater, the system including sensing and control apparatus configured for location at each display case in the array of display cases, the apparatus including a frame temperature sensing unit adapted for mounting at the display case for monitoring temperature of one of the display case door or display case frame, a dew point sensing unit adapted for mounting at the display case for monitoring ambient air temperature and relative humidity outside of the display case, an internal case temperature sensing unit positionable inside the display case, and processing means mountable at the display case and connected for activating the display case frame/door heater when monitored display case door or frame temperature drops below a first preselected set point above a dew point value derived from monitored ambient temperature and relative humidity, for deactivating the frame/door heater when monitored display case door or frame temperature rises above a second preselected set point above the dew point value, and for storing data related to readings at the sensing units and operation of the frame/door heater, and a communication control unit associated with the processing means for coordinating programming and data download access to the processing means of the apparatus.

It is yet another object of this invention to provide a method for condensation control at a refrigerated display case having at least one door, a frame and at least one frame/door heater, the method including the steps of placing a temperature sensing unit in contact with the display case frame to monitor case frame temperature, mounting a dew point sensing unit on the display case to monitor ambient air temperature and relative humidity outside the display case, and utilizing monitored case frame temperature, ambient air temperature and relative humidity to anticipate formation of condensation at the display case and activating and deactivating the frame/door heater responsive thereto.

With these and other objects in view, which will become apparent to one skilled in the art as the description proceeds, this invention resides in the novel construction, combination, and arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
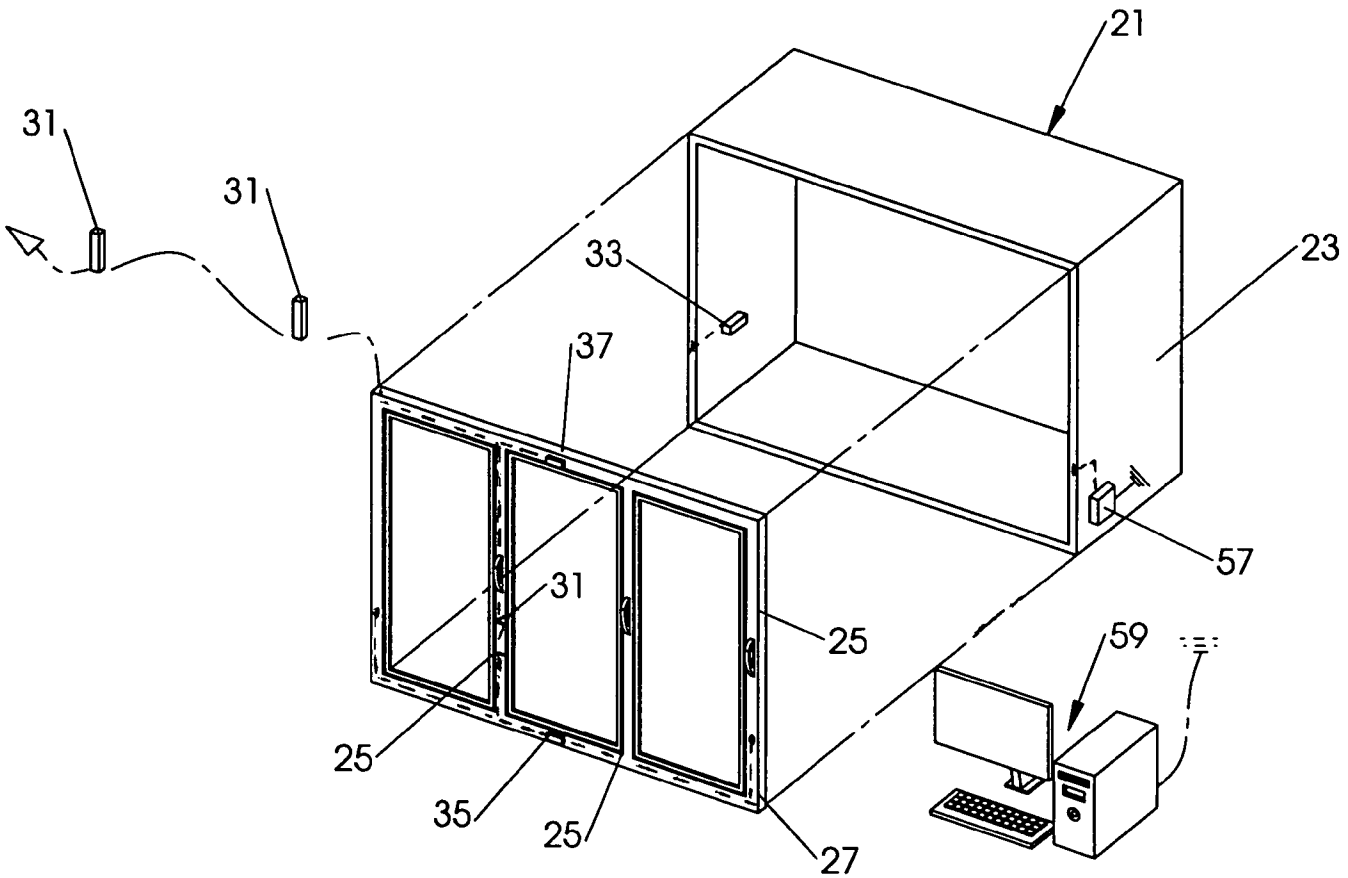
FIG. 1 is a diagrammatic illustration of one embodiment of the condensation prevention apparatus and system of this invention.

The system of this invention is illustrated in FIG. 1 in association with a common commercial freezer/cooler display unit 21 including a display container 23 having a frame (not shown in this FIGURE) and doors 25 in frame 27 (hereinafter, refrigeration case(s)). Up to fifteen such cases 21 can be served by the system as currently configured (though greater or fewer cases could be accommodated). Each case 21 is provided with a local controller unit 31 connected with an array of case sensors including internal case temperature sensor 33, external case frame temperature sensor 35 and dew point sensor 37. The array of sensors may be hard wired (as shown herein) to unit 31 at each case 21 through frame members, or may be configured to function wirelessly utilizing known technologies. While separate frame temperature and dew point sensors 35 and 37 are shown in this FIGURE, an alternate configuration that combines both sensors into one housing is shown hereinafter. Sensor mounting positions may be selected as desired, though the configuration illustrated in FIG. 1 is preferred where the sensors are separately housed.

Figure 2:
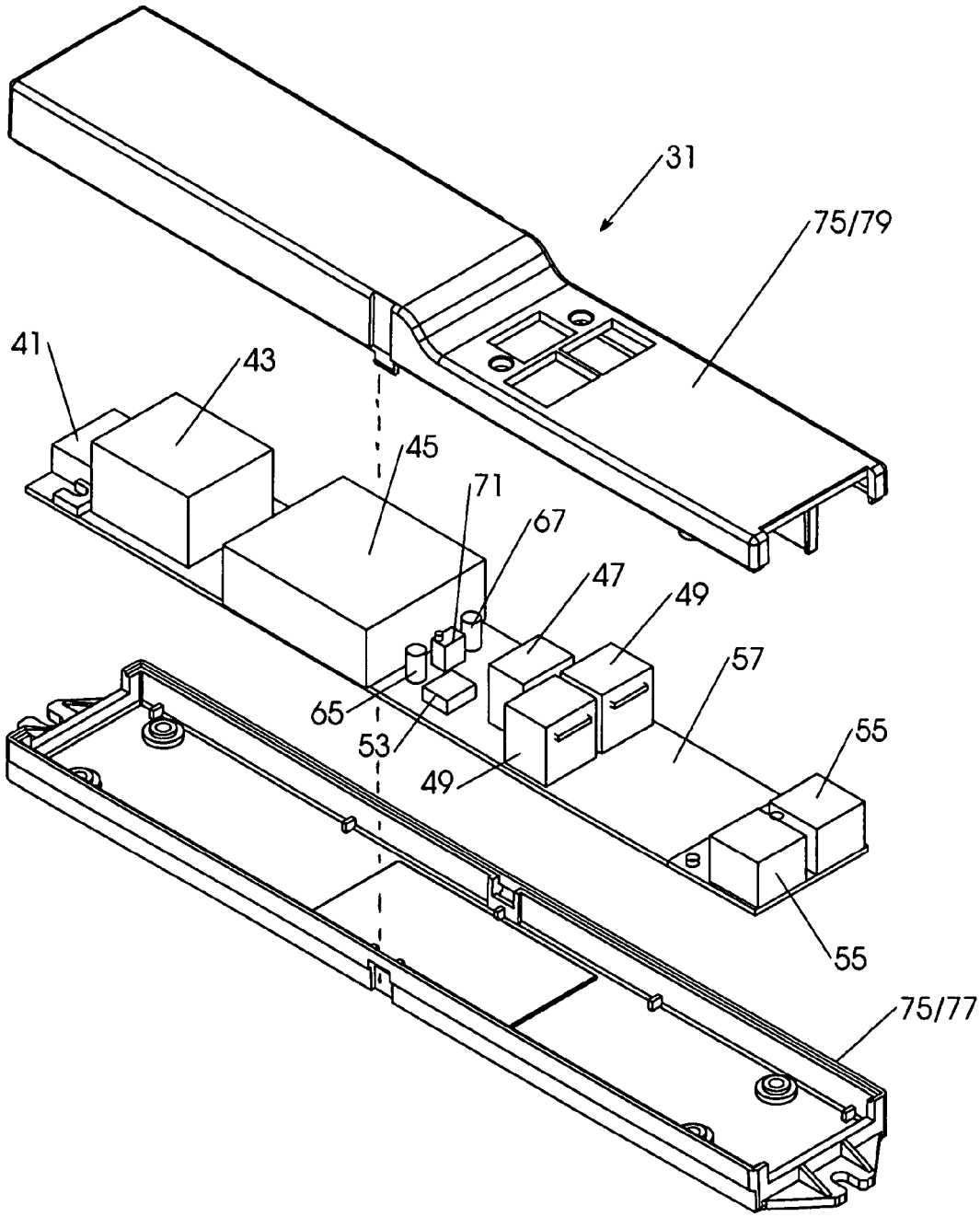
FIG. 2 is an exploded view of the local controller unit of the apparatus of this invention.
Figure 3:
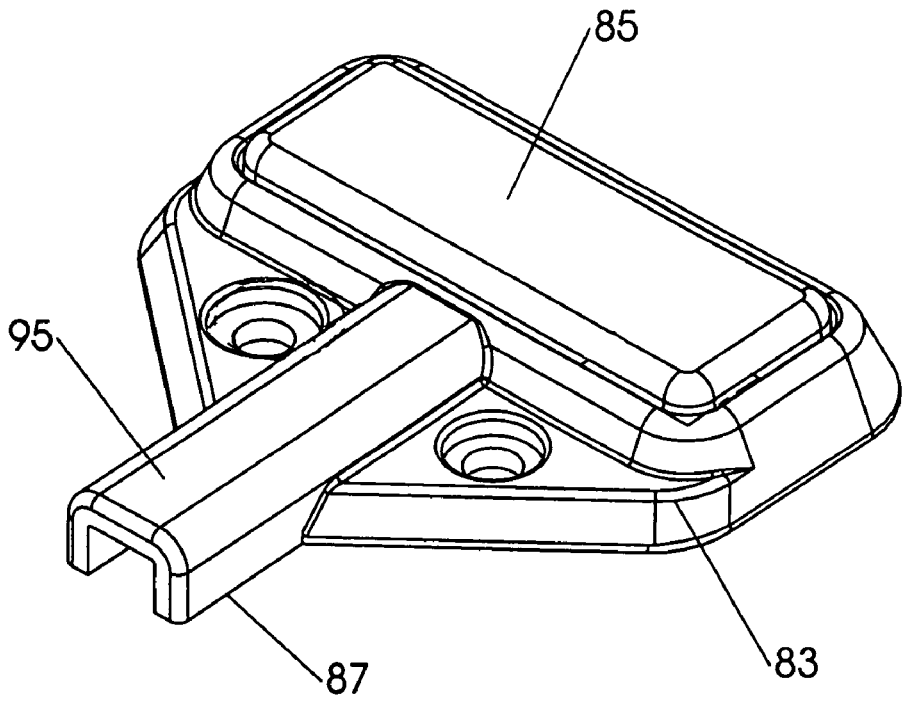
FIG. 3 is a perspective view of the case temperature sensor and housing of the apparatus of this invention.

Controller unit 31 is illustrated in FIG. 2. AC power connector 41, switching relay 43, transformer 45, internal case temperature sensor connection (an RJ-22 connector for example) 47, frame temperature sensor and dew point sensor connectors (RJ-11 type connectors, for example) 49 are located on circuit board 51. Microprocessor 53 is located on board 51, as are in-coming and out-going connectors 55 (RJ-45 type connectors, for example) utilized so that a number of serially connected control units 31 are connectable with a single communication board/transmitter/receiver 57 in communication with receiver/transmitter/centralized processing 59 (FIG. 1). LED's 65 and 67 (preferably green and red, respectively) on board 51 flash to indicate a status update from central processing 59 to microprocessor 53 (LED 65) and to indicate that relay 43 has switched power on to frame/door heaters (LED 67). Reset/programming interface 71 is mounted between LED's 65/67 at board 51.

Board 51 is maintained in housing 75 including first and second housing portion 77 and 79, respectively, with all connectors, LED's and user interfaces provided with access openings therethrough. Housing 75 is configured to be mounted between freezer door frame mullions where case lighting is typically located (thus providing AC power routing access). The housing is designed to be less than the height and width of a typical heretofore known and utilized mullion lighting lens cover adapted for such cases 21.

Controller unit microprocessor 53 can be calibrated to initiate operations anywhere above or below calculated dew point. Adjustments can be made from central processing 59 with wireless communication via the communications board/transmitter/receiver 57 connected to controller unit 31. Central processing 59 (a PC for example) receives data from units 31 via communications board/transmitter/receiver 57, including data enabling tracking, storing and making available reports of the history of ambient air temperature and humidity from dew point sensor 37, case frame and internal case temperatures from sensors 35 and 33, respectively, and power consumption of door heaters (all as shown herein in FIG. 15). This information can be used to improve energy efficiency by recalibrating operating ranges of the apparatus and system of this invention, as well as for improved operational cost accounting.

The internal case temperature must remain below FDA approved levels or food will spoil, such being both a health concern as well as an expense to the installation for potential loss of goods. It has heretofore been difficult to determine if temperature are within guidelines 24 hours a day. Utilization of the apparatus and system of this invention, however, and particularly utilization of internal case temperature monitoring by sensor 33 through controller unit 31, allows such detailed tracking and reporting. Moreover, the apparatus and system are configured to automatically send an alarm (one or both locally and by autodialer to a responsible technician) if maximum allowable internal case temperature as programmed is exceeded. If central processing 59 receives an alarm message from any of the local control units 31 in the system, an alarm or auto dial via a modem is initiated and a message is sent with regard thereto, including the exact case in the system wherein temperature has deviated (see FIGS. 14 and 15).

Figure 5:
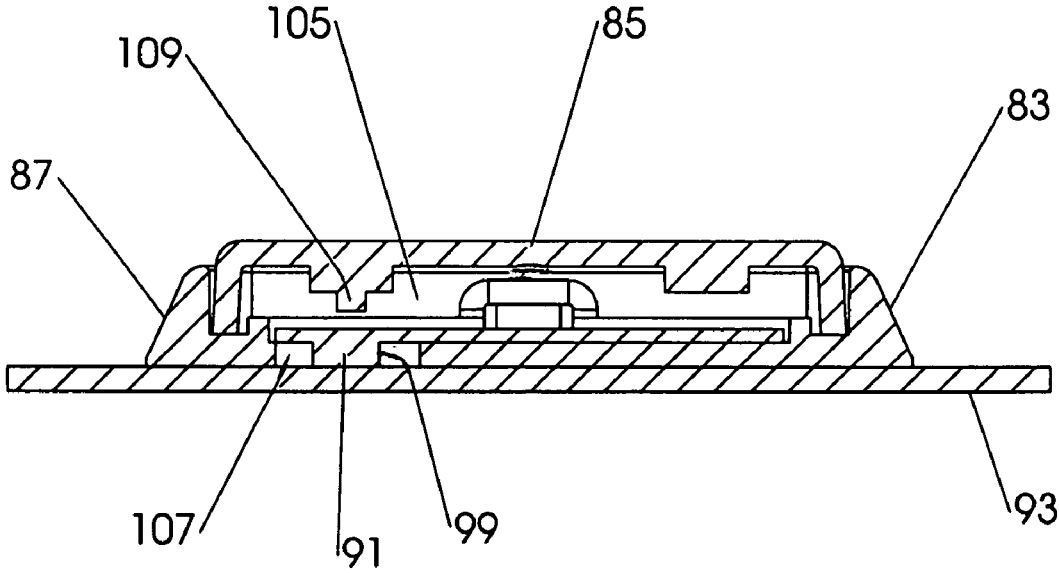
FIG. 5 is a sectional view of the sensor/housing of FIG. 3.
Figure 4:
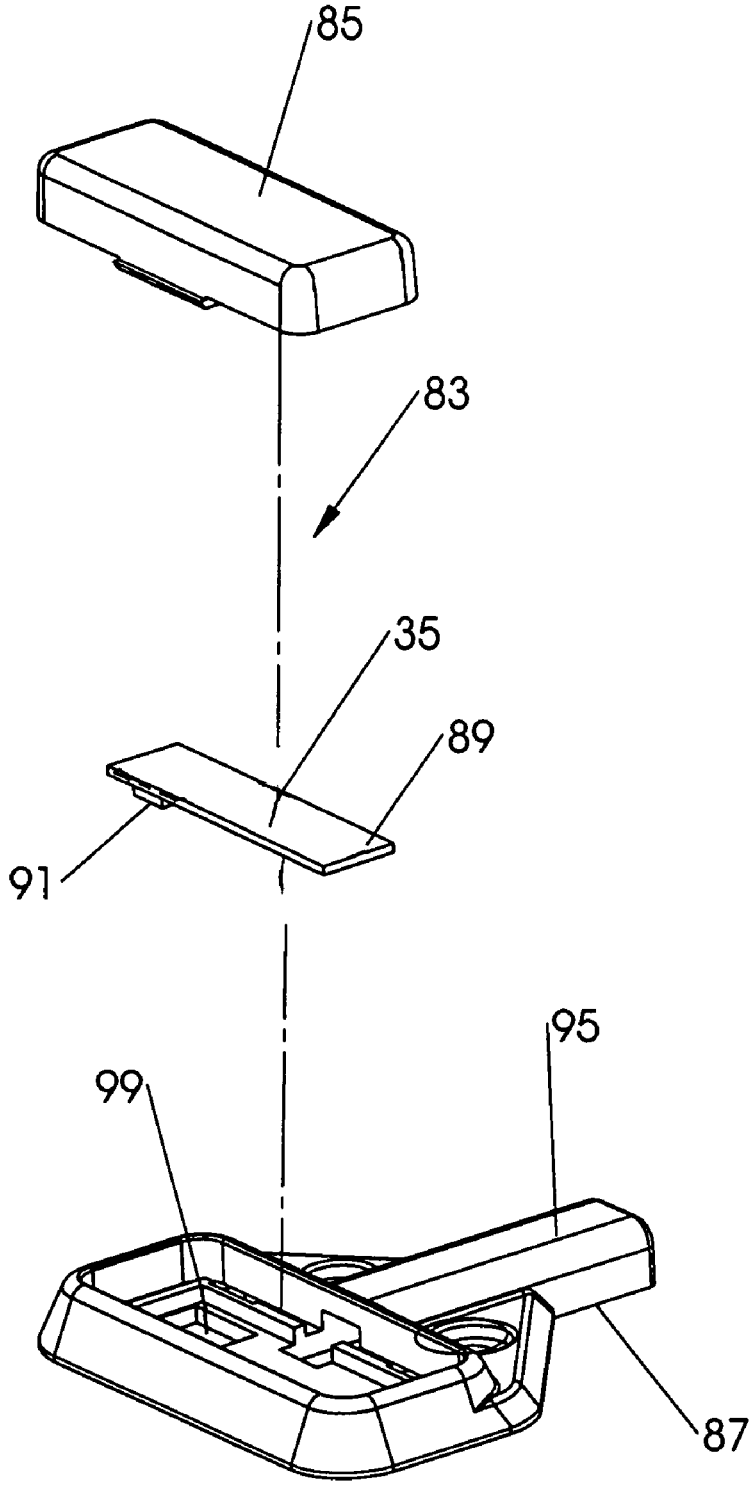
FIG. 4 is an exploded view of the sensor/housing of FIG. 3.
Figure 6:
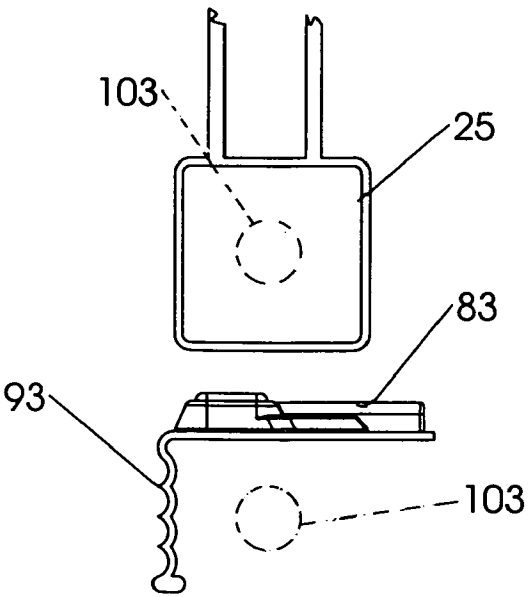
FIG. 6 is an illustration showing positioning of the sensor/housing of FIG. 3.

Temperature sensors 33 and 35 are similar and are housed as illustrated in FIGS. 3 through 6 (for purposes of description herein, only the housing of sensor 35 will be described since sensor 33 in much simpler to implement and maintain). Temperature sensor 35 housing 83 includes cover 85, sensor locating base 87 and circuit board/carrier 89 locating temperature sensor 35 including temperature sensing chip 91 at one surface thereof. This assembly is mounted to case frame unit or door frame unit 93 of display case 21 utilizing screws or adhesive, with base 87 adjacent frame unit 93 as shown in FIG. 5. Cabling from controller unit 31 is routed through cable protector 95 at base 87.

Temperature sensing chip 91 is located on board/carrier 89 so that when received in housing 83 it is located through sensor opening 99 at base 87. With proper materials sizing, chip 91 will be in direct contact with the surface of unit 93 being monitored when base 87 is mounted on frame unit 93. Housing 83 should be located at the coldest spot on the exterior of the freezer. That spot is usually in the center of the case between the bottom of a door 25 and door or case frame unit 93 (see FIG. 6). Door and frame heaters 103 are located inside doors and/or frames of cases 21.

Housing 83 is configured at cover 85 and base 87 to thermally isolate sensing chip 91 from the warming effects of ambient air temperature in the vicinity of the chip and transfer thereof by the housing to the chip. Air space pockets 105 and 107 above and around chip 91, respectively, and limited housing contact (see FIG. 5 wherein only a single locating post 109 maintains board/carrier 89 at it position in housing 83) isolate chip 91 from the housing. By thus configuring board/carrier 89 (made typically of FIBERGLASS material) and housing 83 (preferably made of plastic such as acrylonitrile butadiene styrene polycarbonate) little transfer of heat to sensor chip 91 occurs, assuring accurate measurement of surface temperature of unit 93 unaffected by inaccuracies introduced as artifact into the measurement by ambient air temperature conditions in the vicinity of housing 83 (accuracy of frame temperature measurements has been documented by testing to be within 1 or 2 degrees Centigrade).

Air space pocket 105 is created by the depth of cover 85 adjacent board/carrier 89, the cover also insulating the sensor chip from the ambient. Air space pocket 107 is created by opening 99 having an opening area greater than surface area of chip 91. These improvements allow accurate tracking and monitoring of case frame temperature, used not only for precisely timed heater activation, but also for better timing of heater deactivation given the fast rise in frame temperature after frame/door heaters 103 are activated to prevent condensation.

Figure 7:
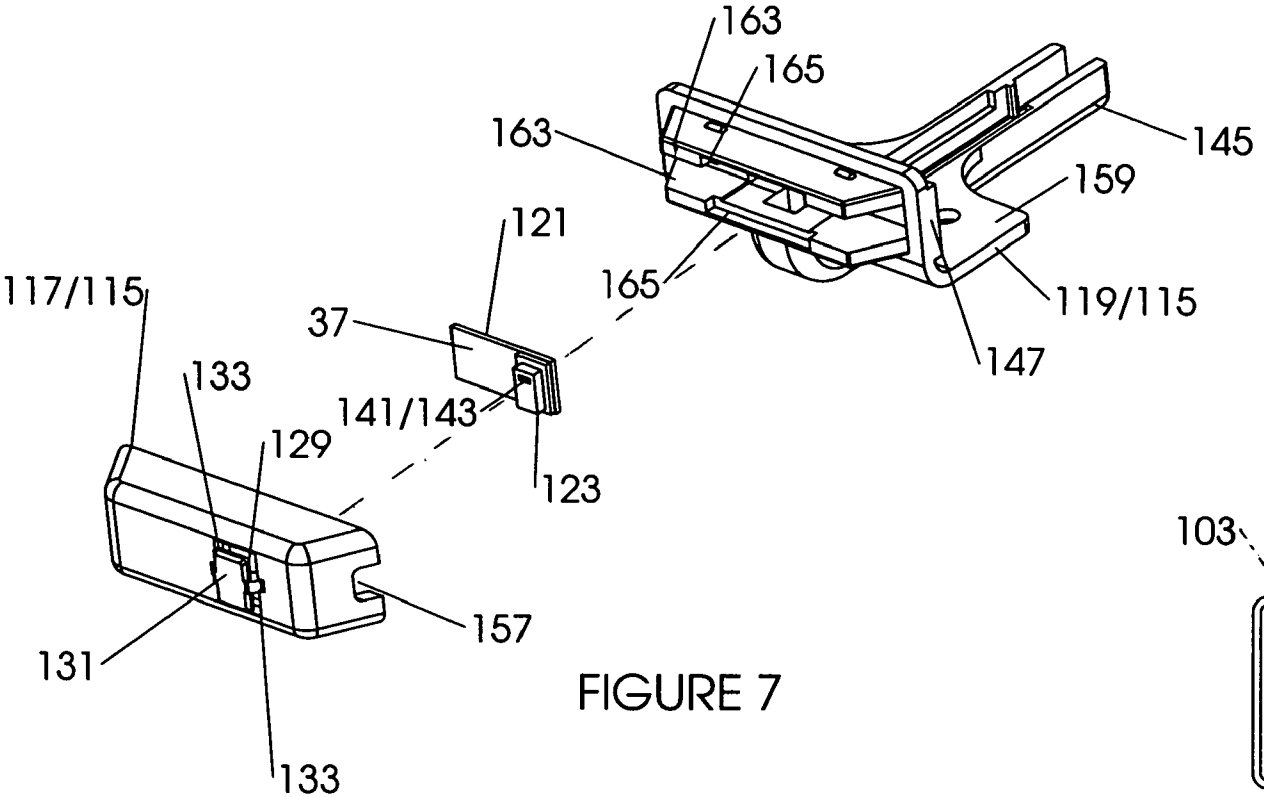
FIG. 7 is an exploded view of the dew point sensor and housing of the apparatus of this invention.
Figure 8:
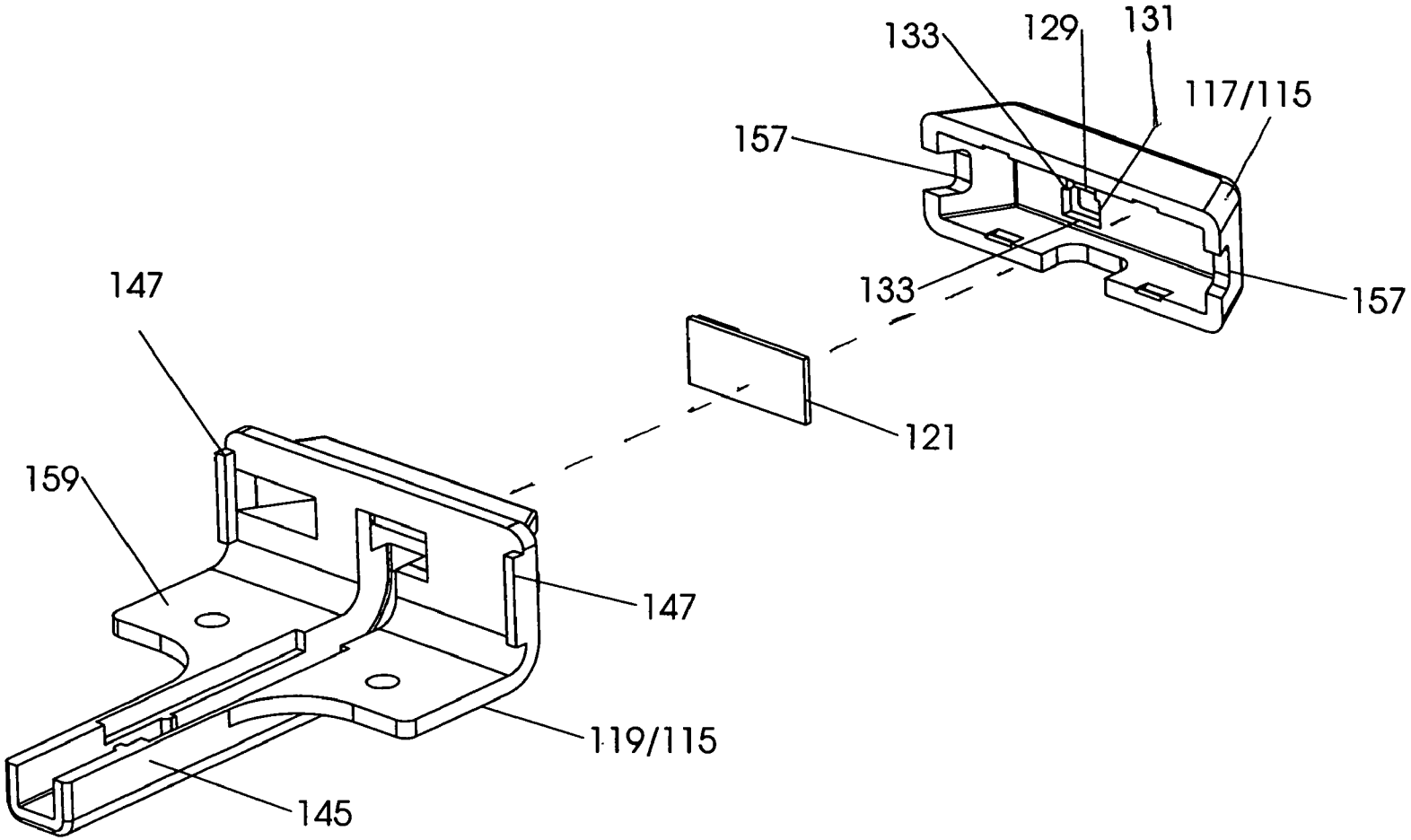
FIG. 8 is a reverse exploded view of the sensor/housing of FIG. 7.
Figure 9:
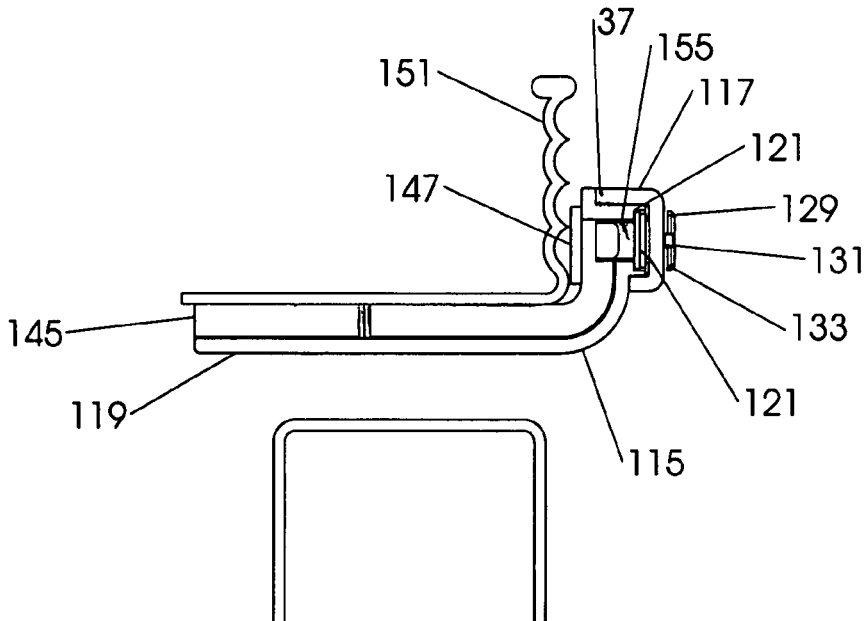
FIG. 9 is an illustration showing positioning of the sensor/housing of FIG. 7.

Turning now to FIGS. 7 through 9, dew point sensor 37 is housed in housing 115 including cover 117 and mounting base 119. Circuit board/carrier 121 maintains sensor 37 circuitry including dew point sensing chip 123. Dew point sensing chip 123 is located, when assembled, in opening 129 in the face of cover 117, opening 129 including protective shield 131 having gaps 133 along the sides thereof to allow airflow over sensing chip 123 for measuring humidity and ambient air temperature. A membrane 141 covers opening 143 at sensing chip 123 to protect internal humidity and temperature sensing components from foreign matter such as cleansers and the like. The design of cover 117 protects membrane 141 without preventing airflow to sensing chip 123.

Housing base 119 includes cabling routing protector 145 for introducing and stabilizing cabling to sensor 37. Spacer ribs 147 at base 119 assure an insulating air gap between housing 115 and its adjacent mounting surface. Housing 115 is preferably mounted to door or case frame unit 151 located at the top of case 21, as shown in FIG. 9, and between the frame unit and door 25 so that the cold air exiting the case when a door is opened will not affect the sensor readings.

Housing 115 is configured to thermally isolate dew point sensor 37 so that accuracy of the dew point sensor is maintained within to 1 to 3 degrees Centigrade. First, by assuring that sensor 37 is held away from the unnaturally heated frame (either cooled by the freezer or heated by frame heaters) with spacer ribs 147, the frame temperature will not influence the relevant dew point readings (primarily ambient air temperature). The air pocket (155 in FIG. 9) behind board/carrier 121 and extending all the way to the mounting surface at unit 151 prevents thermal transfer through housing 115 from the mounting surface of frame unit 151. The cover includes openings 157 at opposite ends thereof to provide room temperature airflow at air pocket 155 of room temperature air. Housing mounting surface 159 is perpendicular to the dew point sensor board/carrier 121, and may be mounted by screws or (preferably) adhesive.

By thus configuring board/carrier 121 (made typically of FIBERGLASS material) and housing 115 (preferably made of plastic such as acrylonitrile butadiene styrene polycarbonate) little transfer of heat to sensor chip 123 occurs, assuring accurate measurement of ambient air temperature and humidity unaffected by inaccuracies introduced as artifact into the measurement by freezer case 21 frame temperature conditions in the vicinity of housing 115. Housing 115 is configured utilizing board support protrusions 163 defining retainer pockets 165 having minimal contact surface along the outer edges of board/carrier 121 to maintain board positioning, thus further reducing thermal transfer. Depth of housing 115 behind pockets 165 establishes air pocket 155.

When door and frame heaters are activated it is important that they do not affect the reading from sensor 37 of actual room air temperature. This design sufficiently isolates sensor 37 from door and frame temperature swings, thereby preserving accuracy of readings of ambient air temperature and thus accuracy of dew point calculation. Absent such thermal isolation, it is possible for shut-off of heaters to be delayed indefinitely. For example, under the influence of heaters, if temperature readings were to rise at an insufficiently isolated dew point sensor then calculated dew point would increase. In such case, the doors would have to be heated further as the dew point is chased. Heating the doors further would raise the dew point still more in this scenario, thereby beginning an upwardly spiraling cycle until the heaters reach their maximum temperature and finally power off.

Figure 10:
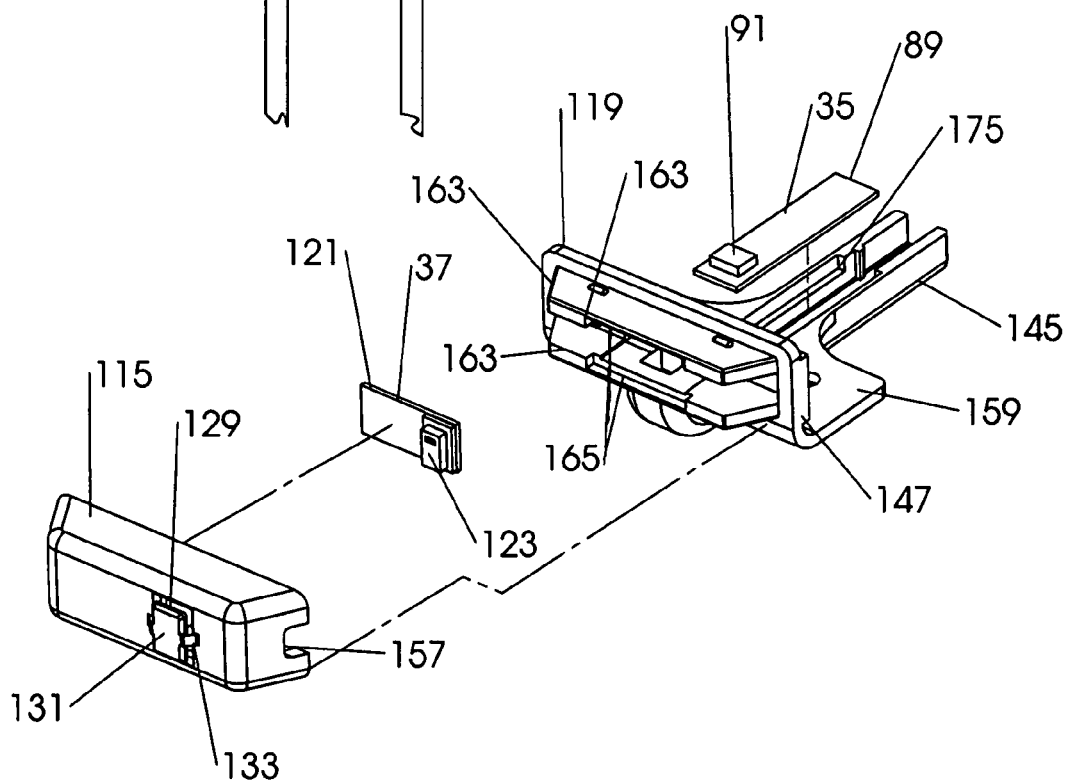
FIG. 10 is an exploded view of an alternative locational, housing and mounting configuration for the sensors/housings illustrated in FIGS. 3 and 7.
Figure 11:
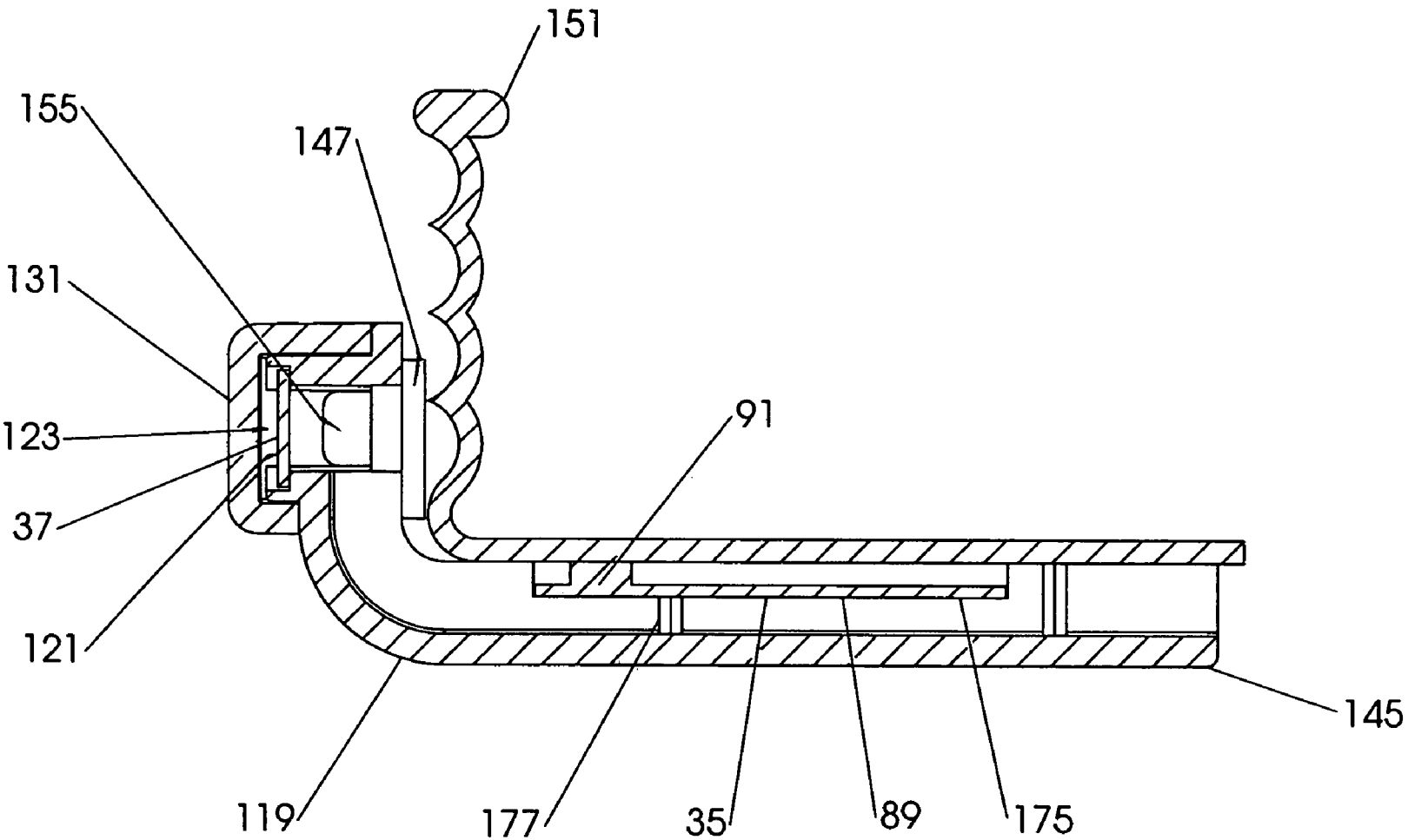
FIG. 11 is a sectional illustration of the sensors/housing of FIG. 10 in a first mounting.
Figure 12:
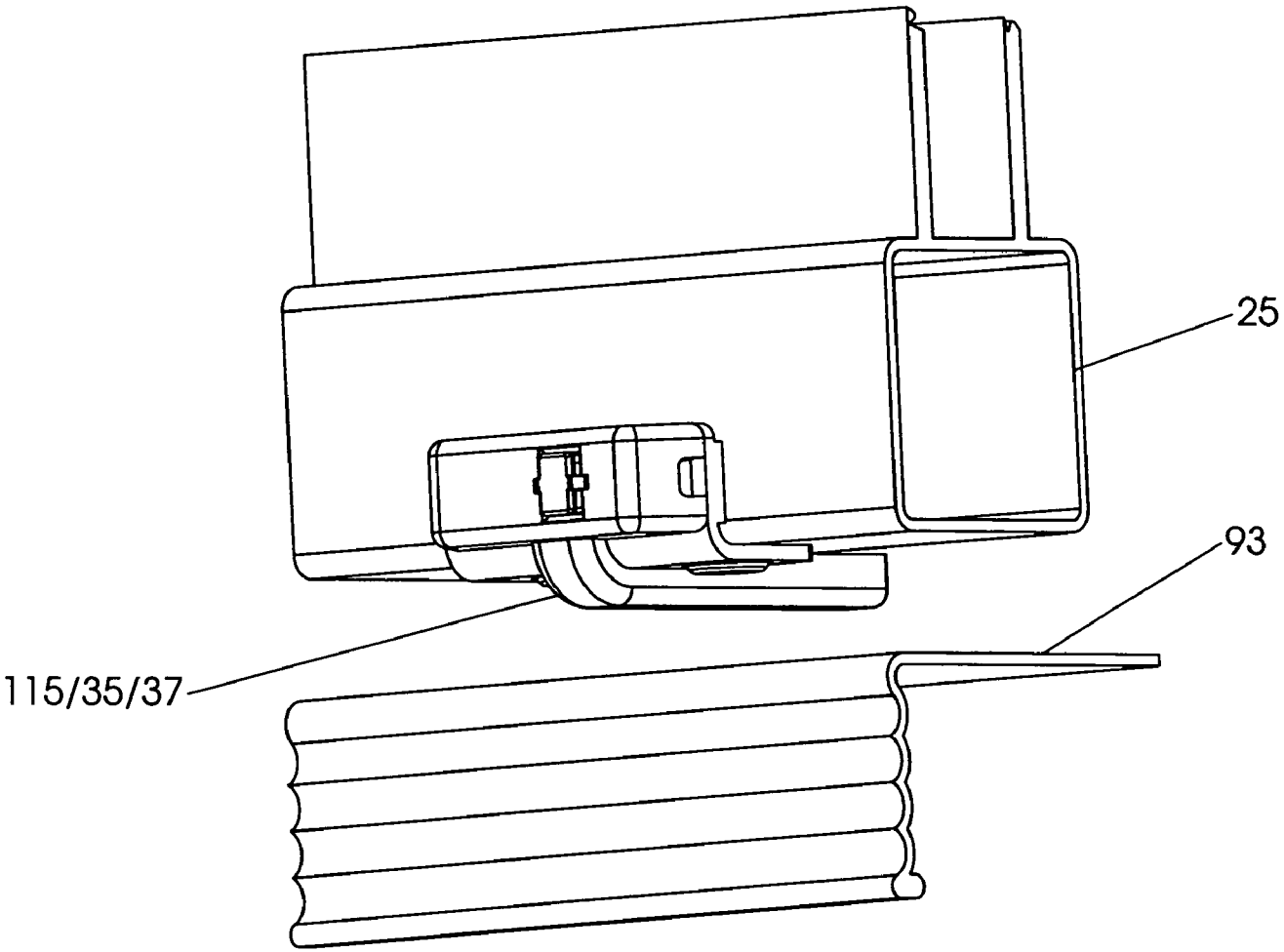
FIG. 12 is an illustration showing positioning of the sensors/housing of FIG. 10 in an alternative mounting.

Turning now to FIGS. 10 through 12, an alternative embodiment for sensors 35 and 37 housing is illustrated wherein housing 115 is utilized to house both sensors. Thus all elements of the housing as heretofore described are the same unless otherwise specified hereinbelow. Sensor 35 is maintained at cabling routing protector 145 at retainer pockets 175 (one on each side, though only one side is shown in the drawings) defining ledges having minimal contact surface with board/carrier 89 to maintain the board, thus reducing thermal transfer through the housing to the board. A single locating post 177 may be utilized to further stabilize the board if necessary. As shown in FIG. 11, sensor 91 and board/carrier 89 are completely surrounded by an insulating dead air pocket established by the depth of protector 145. This housing may be mounted either above (FIG. 11) or below (FIG. 12) door 25 of a case 21, and retains all the thermal isolation advantages discussed for the individually housed units as discussed above.

Figure 13:
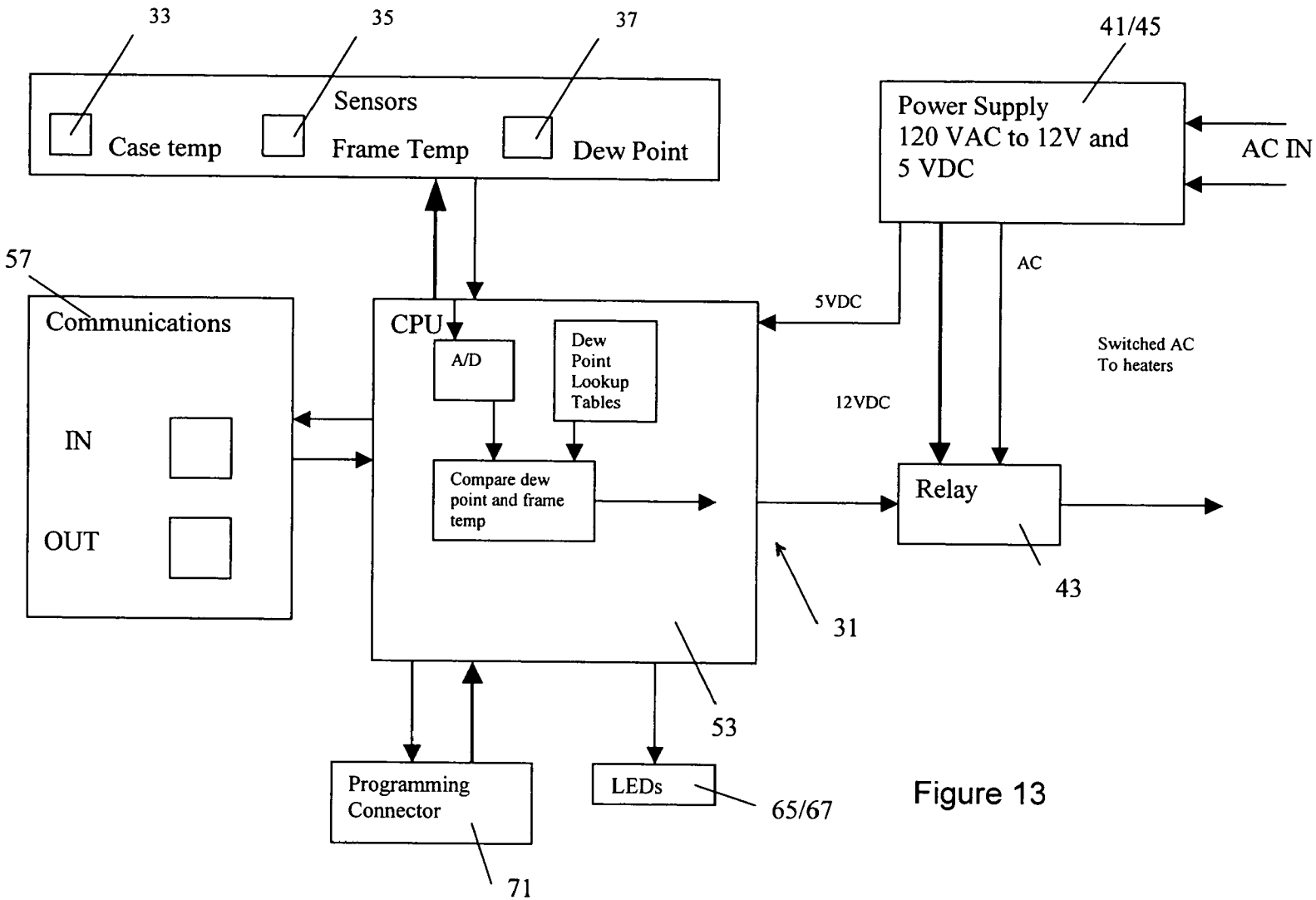
FIG. 13 is an electronics block diagram of the apparatus of this invention.
Figure 14A:
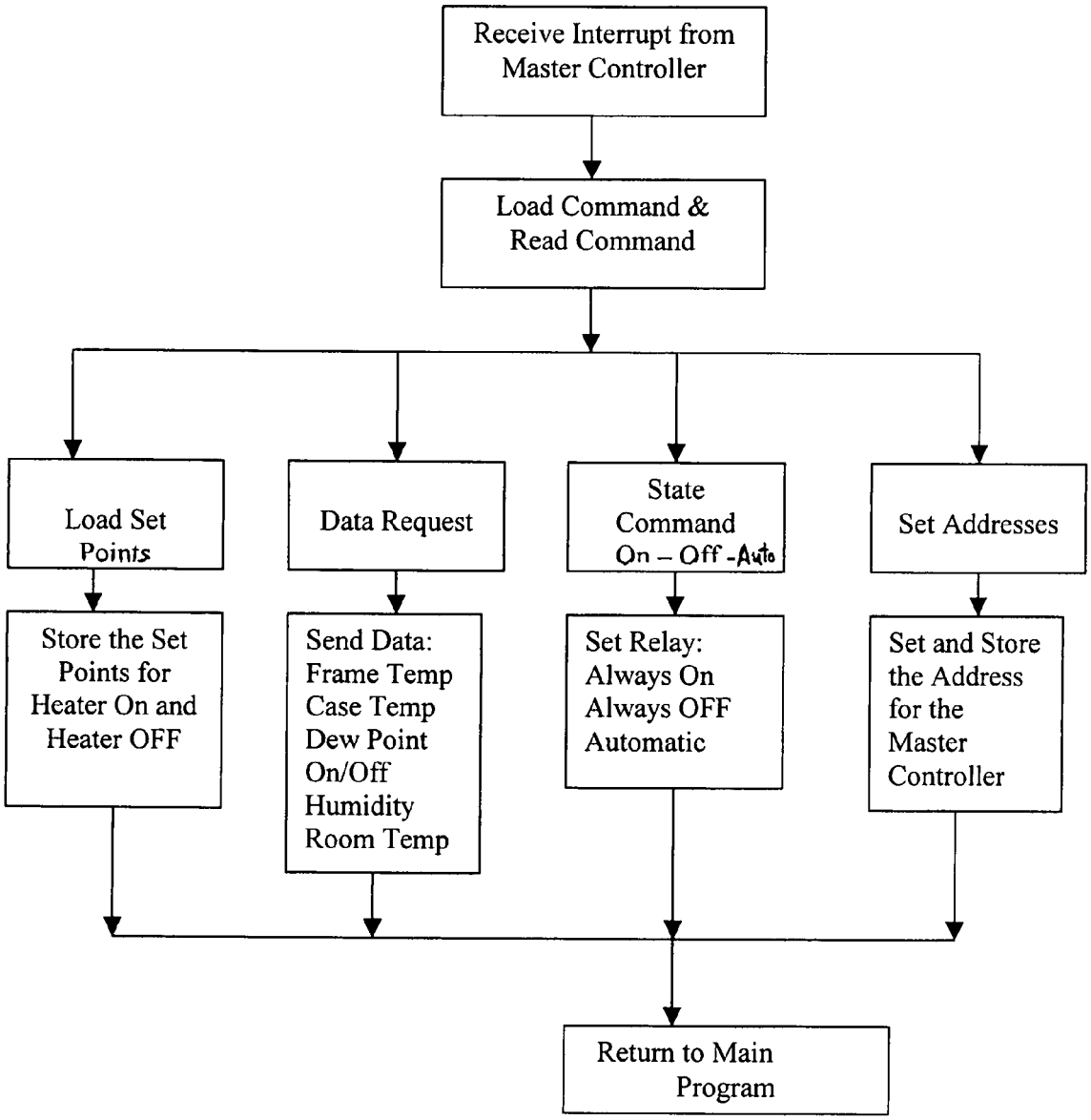
FIGS. 14*a* through 14*j* are flow diagrams illustrating program control of local controller components and communications modules of the apparatus of this invention.
Figure 14B:
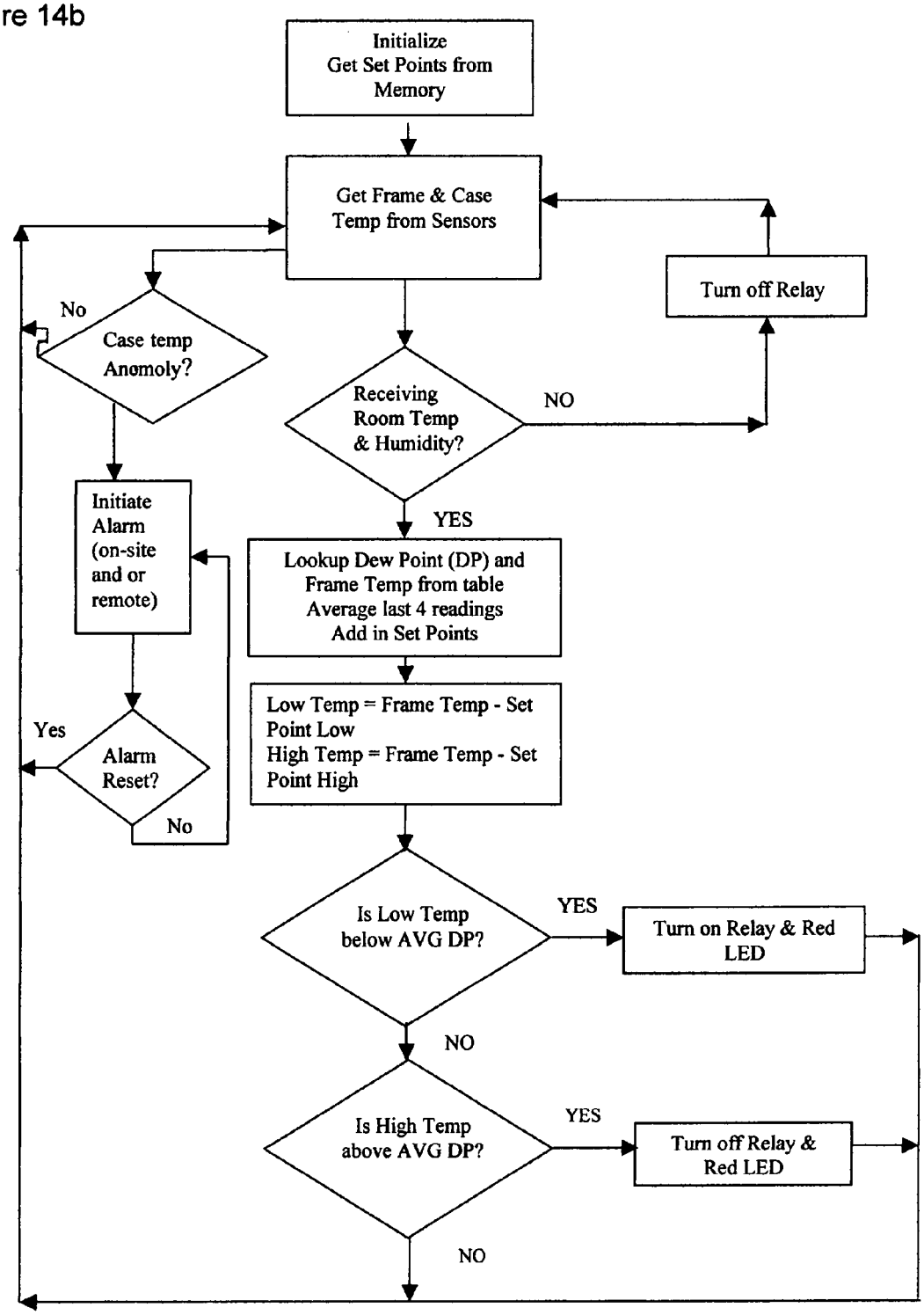
Figure 14C:
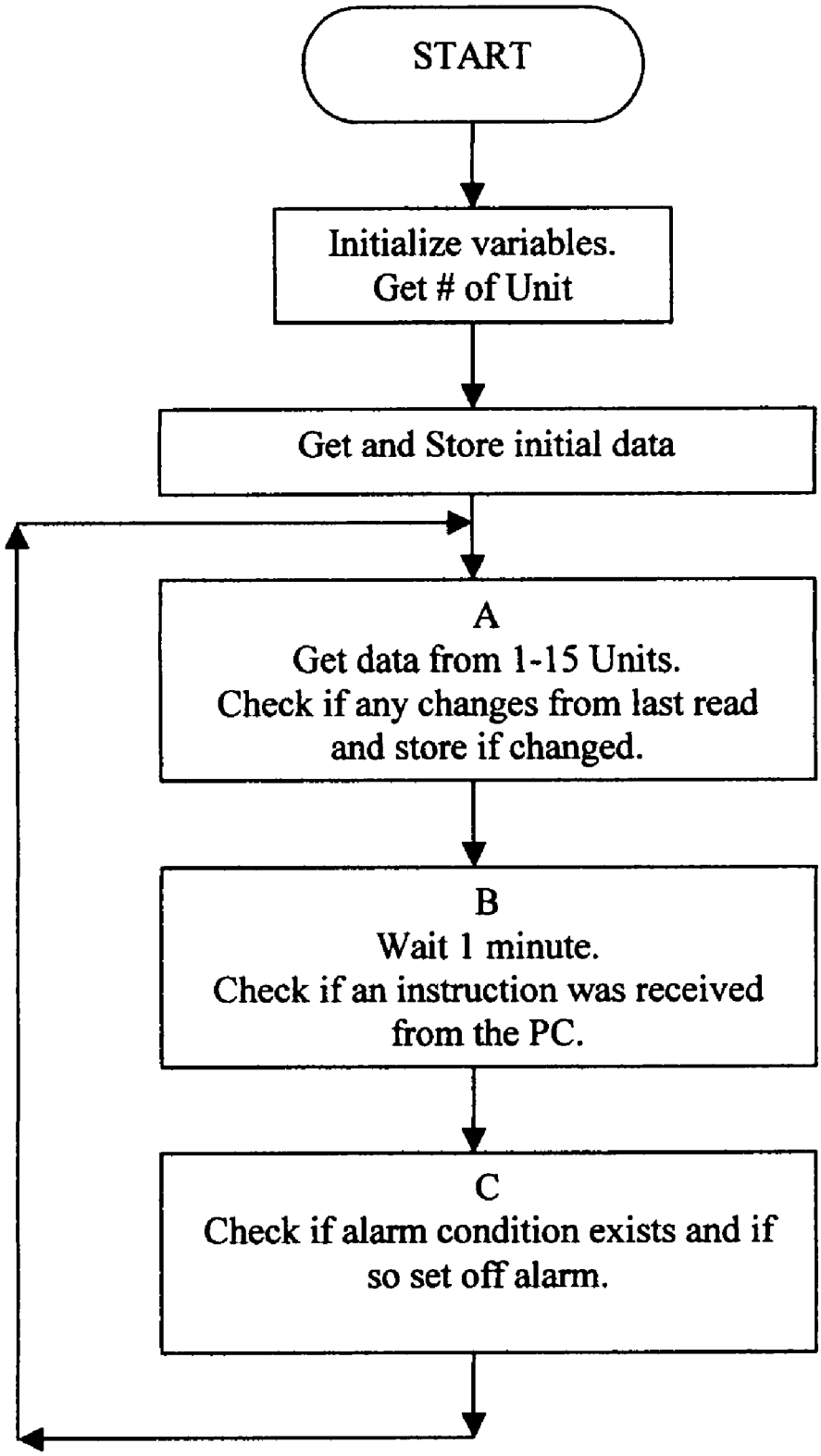
Figure 14D:
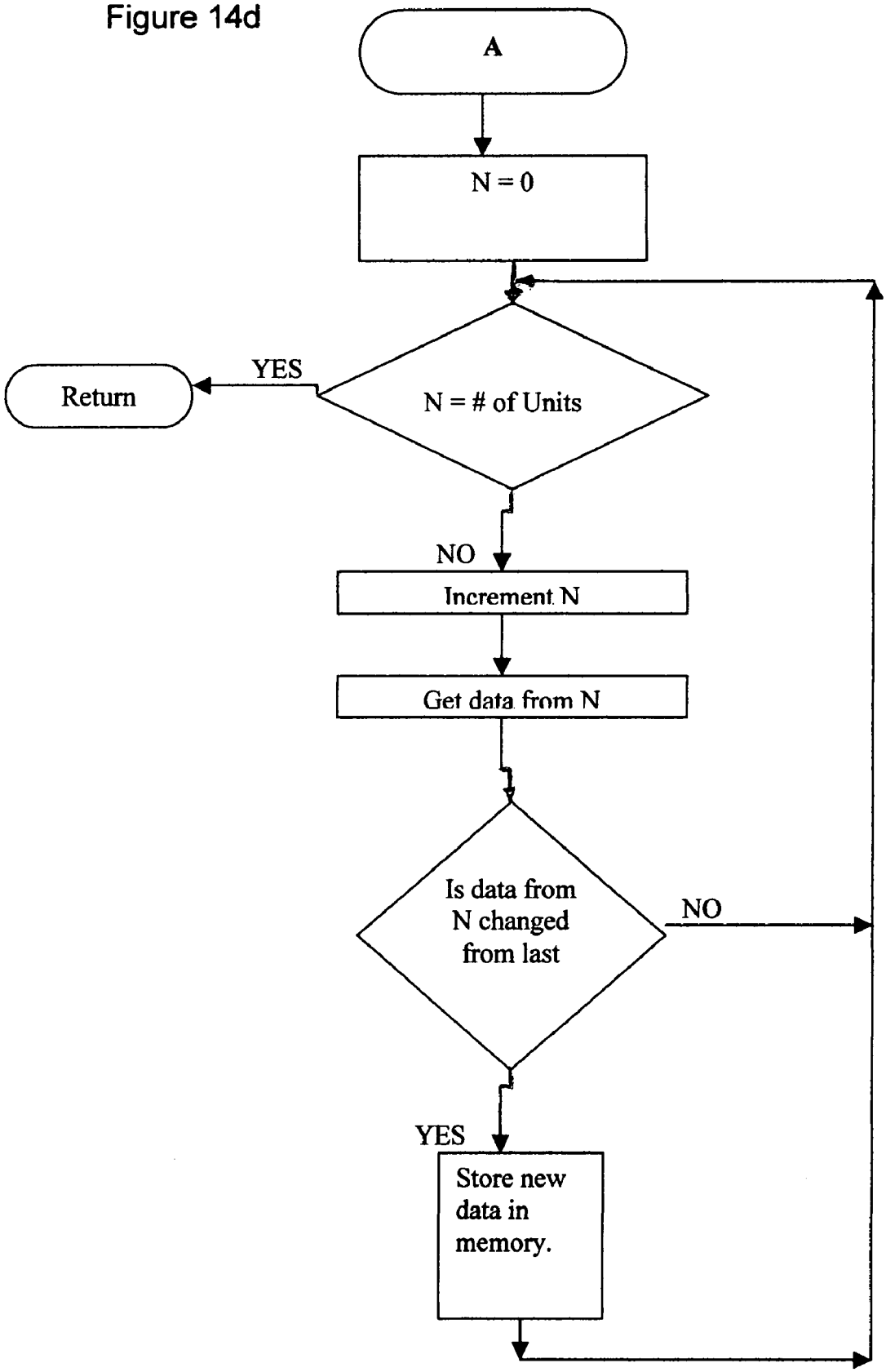
Figure 14E:
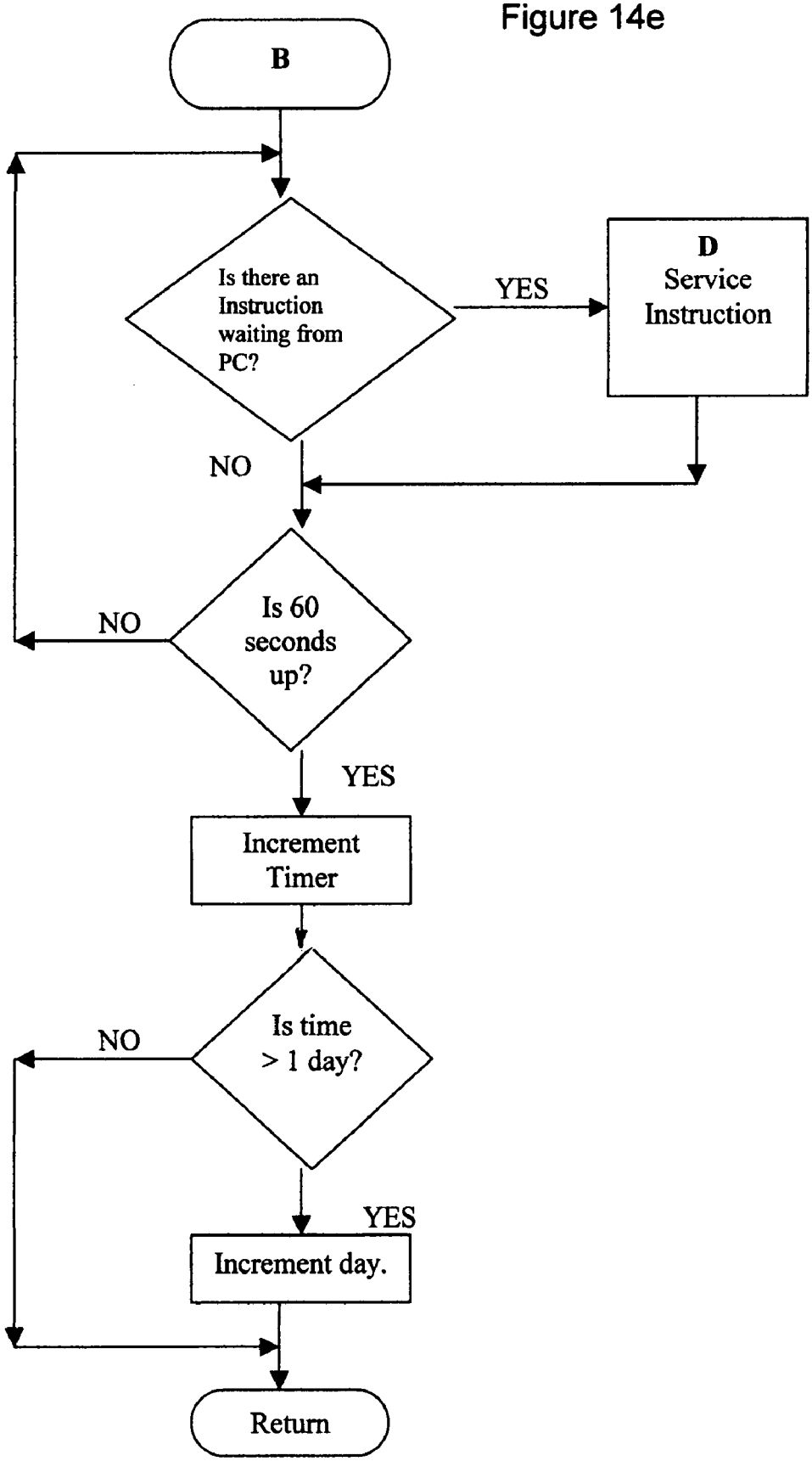
Figure 14F:
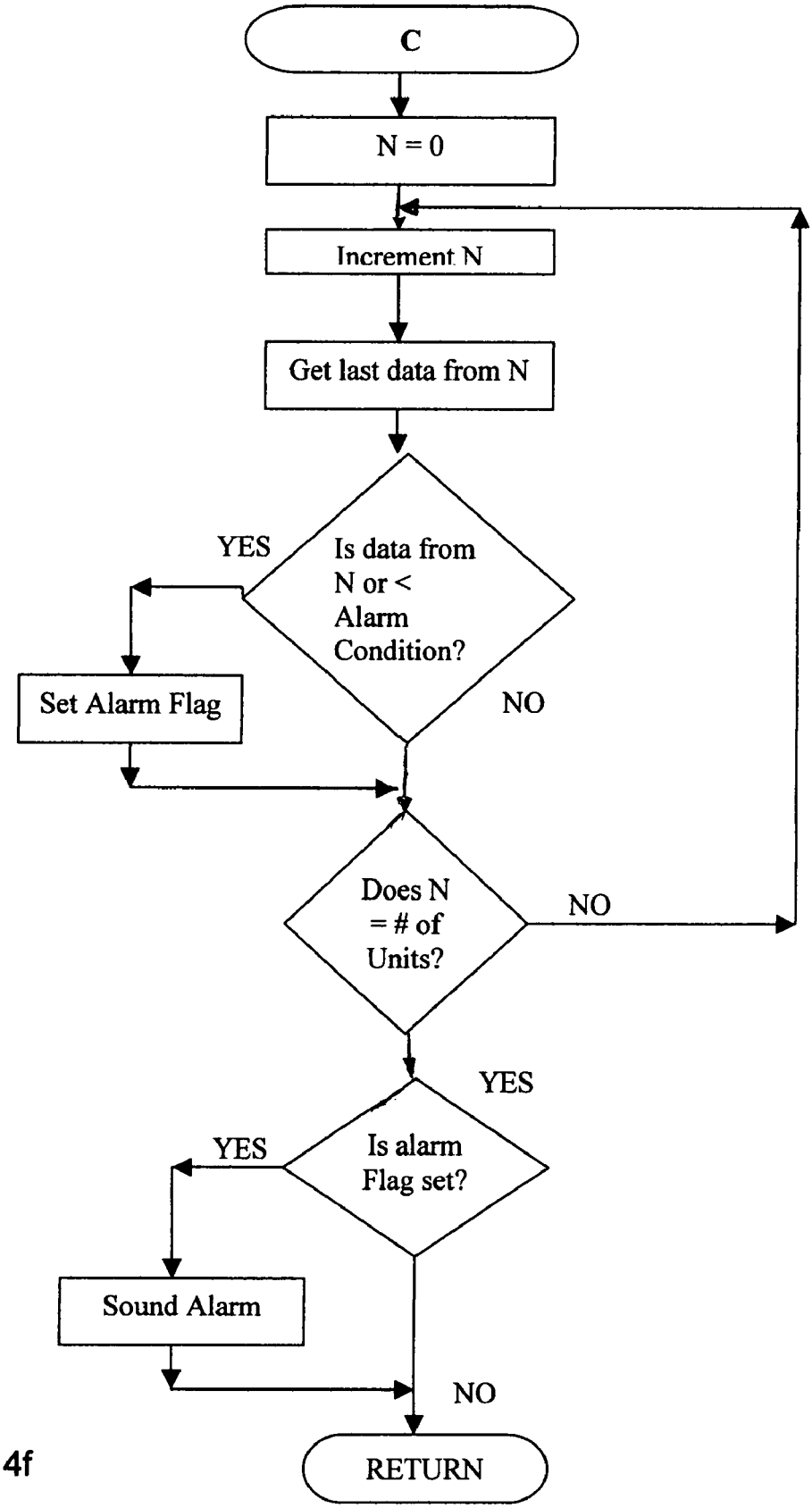
Figure 14G:
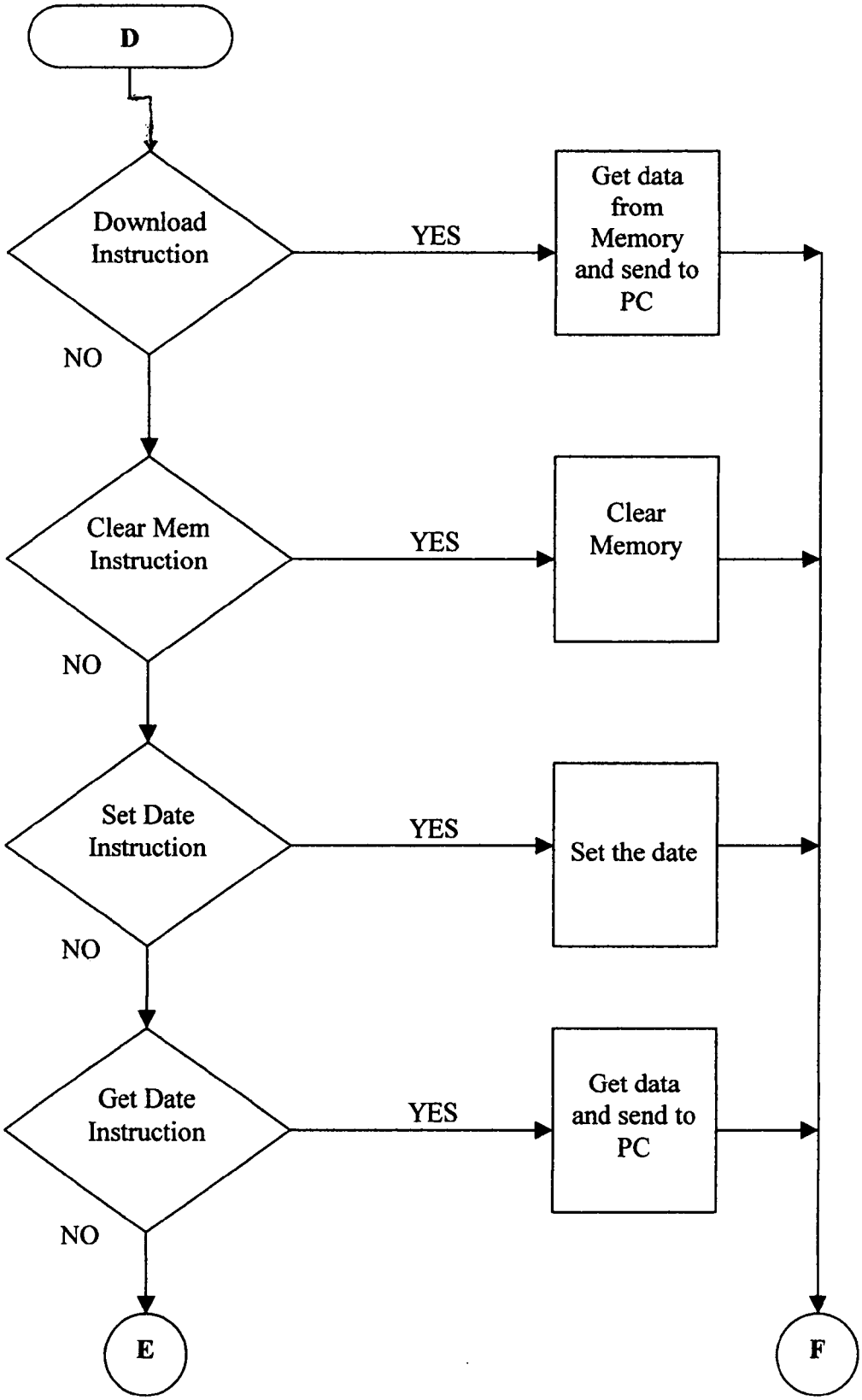
Figure 14H:
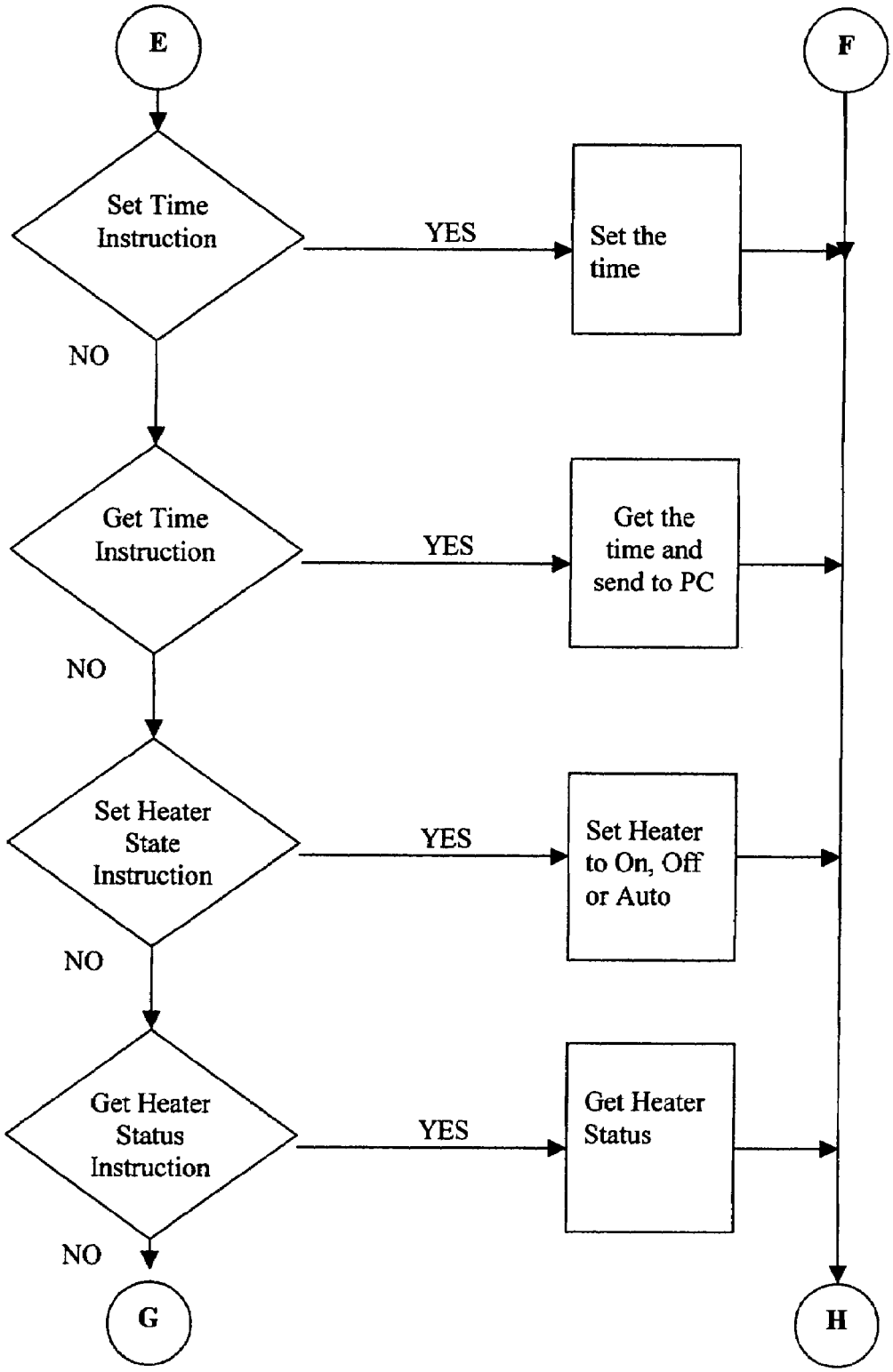
Figure 14I:
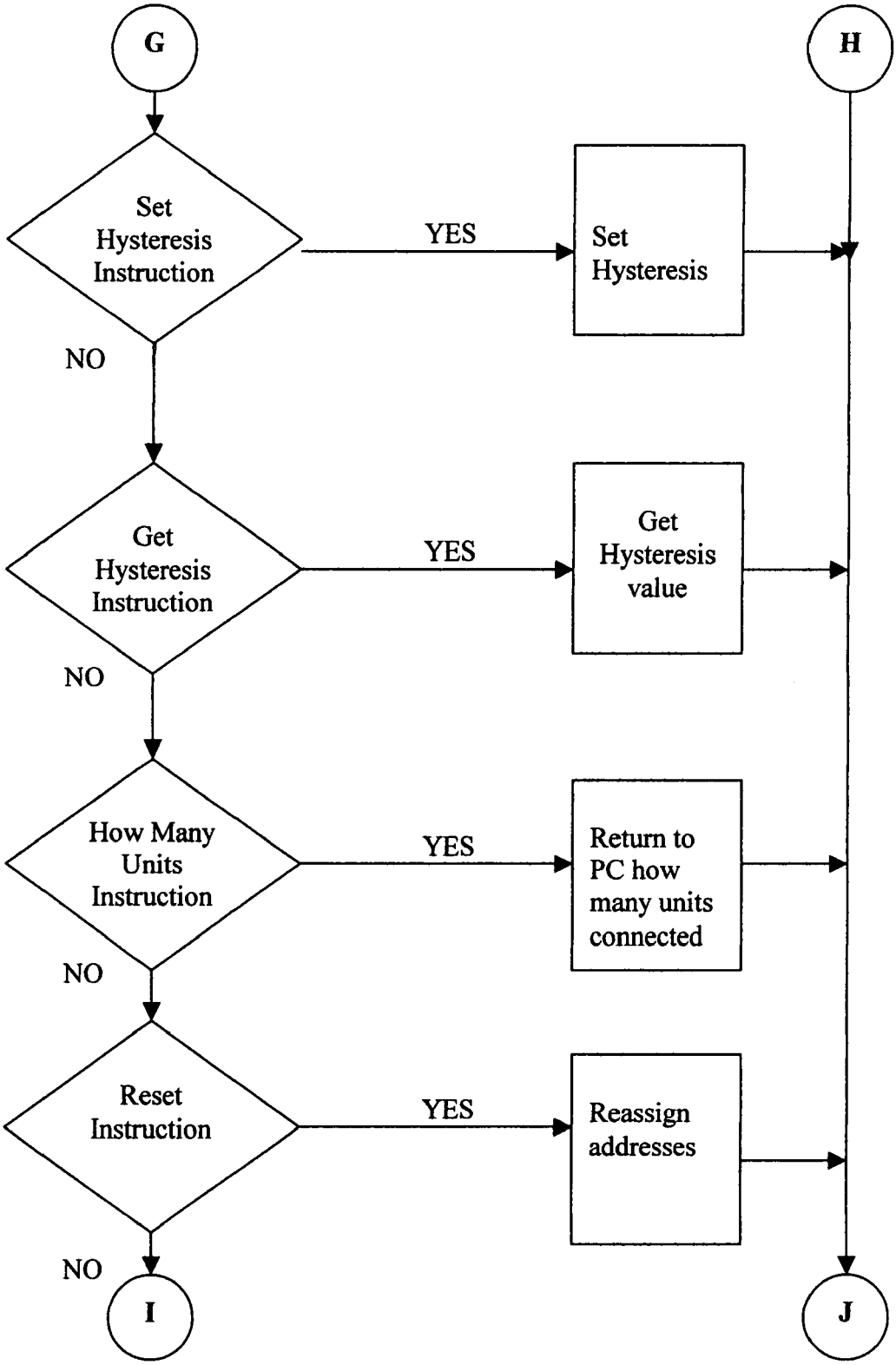
Figure 14J:
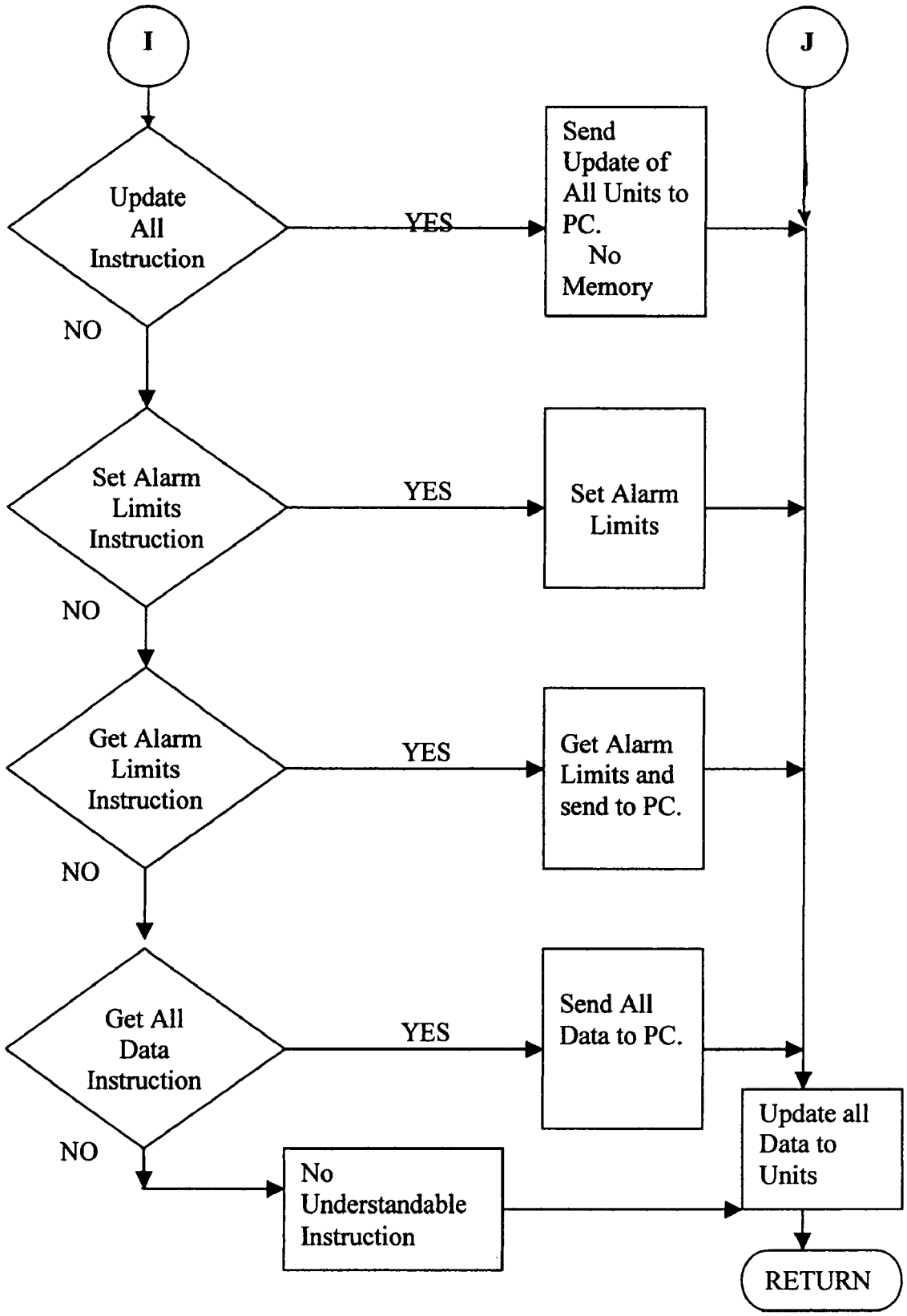
Figure 15A:
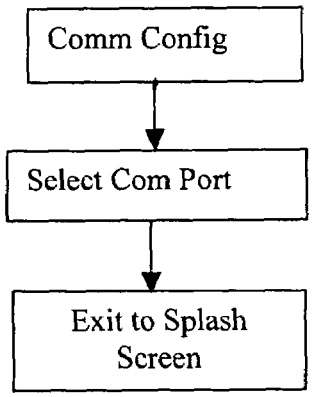
FIGS. 15*a* through 15*q* are flow diagrams illustrating program control at centralized processing (an on- or off-site personal computer for example).
Figure 15C:
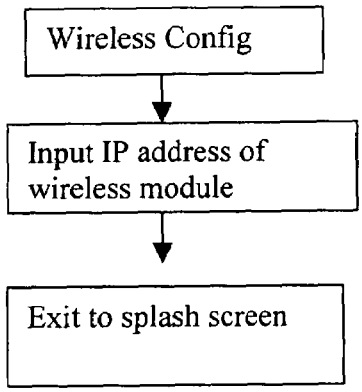
Figure 15B:
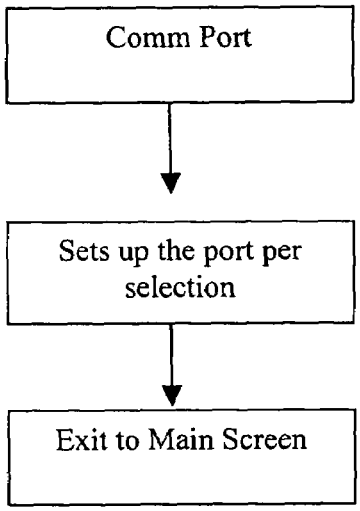
Figure 15D:
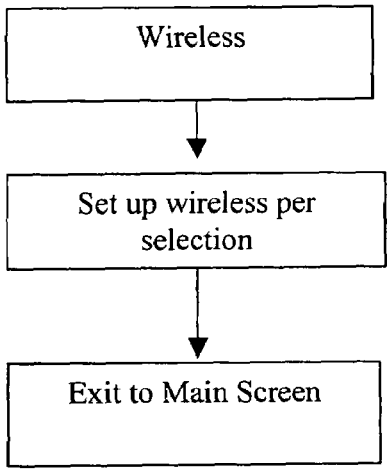
Figure 15G:
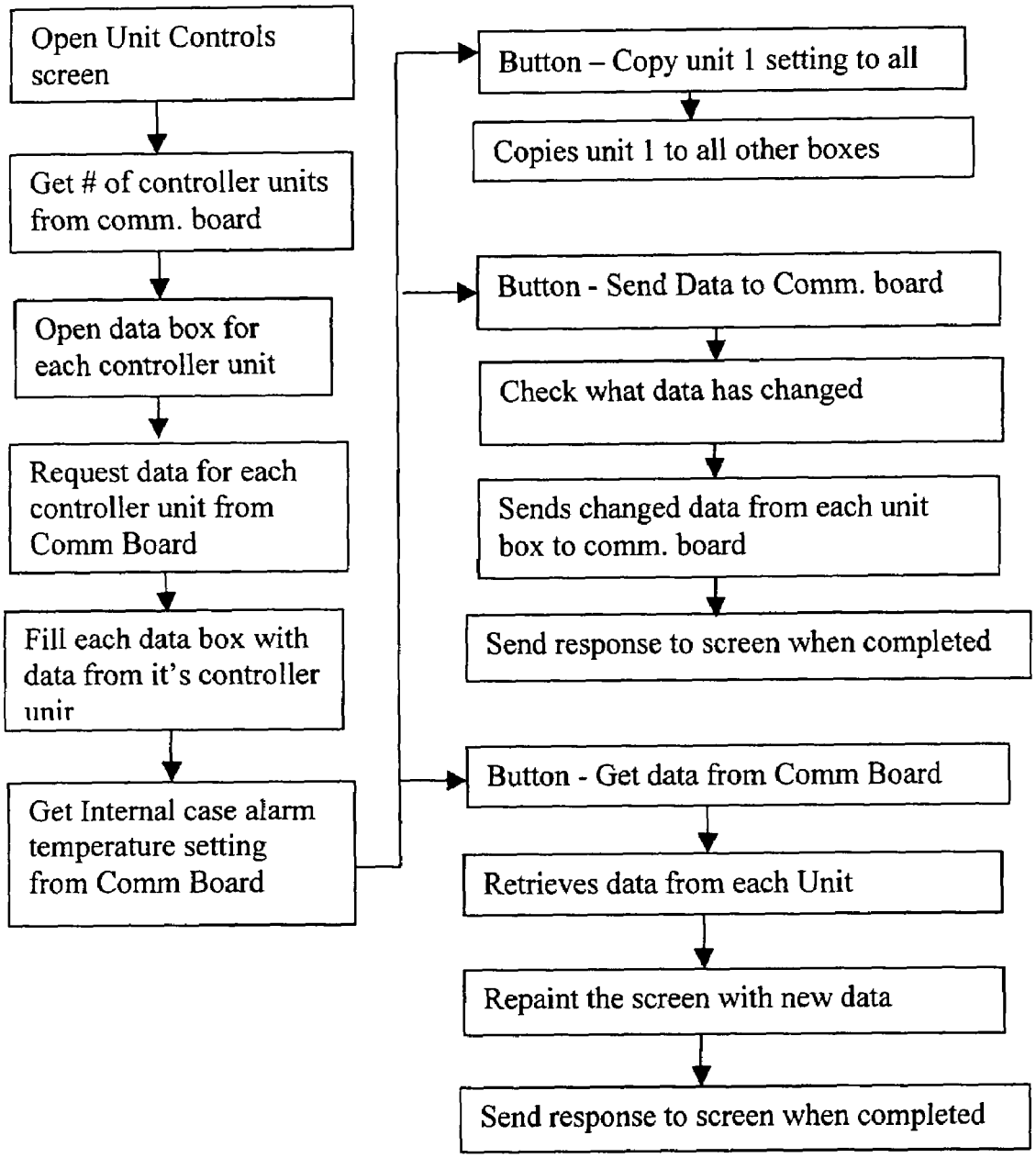
Figure 15H:
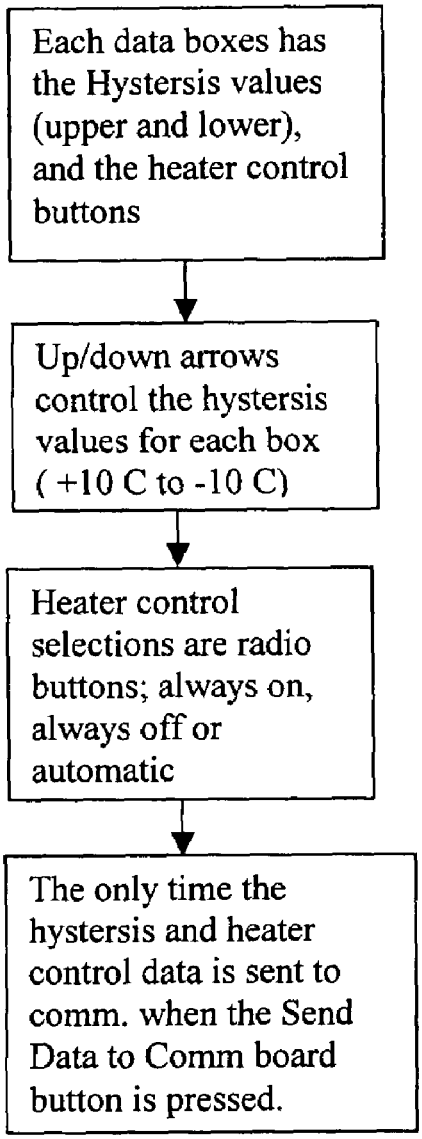
Figure 15I:
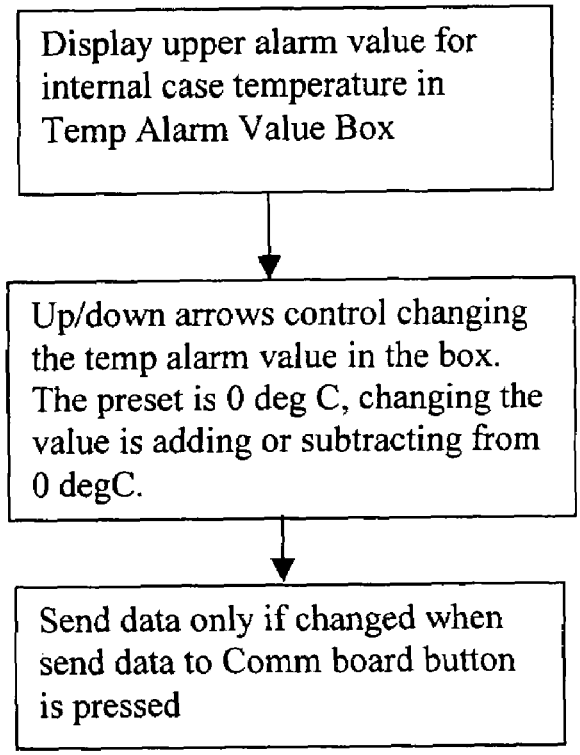
Figure 15J:
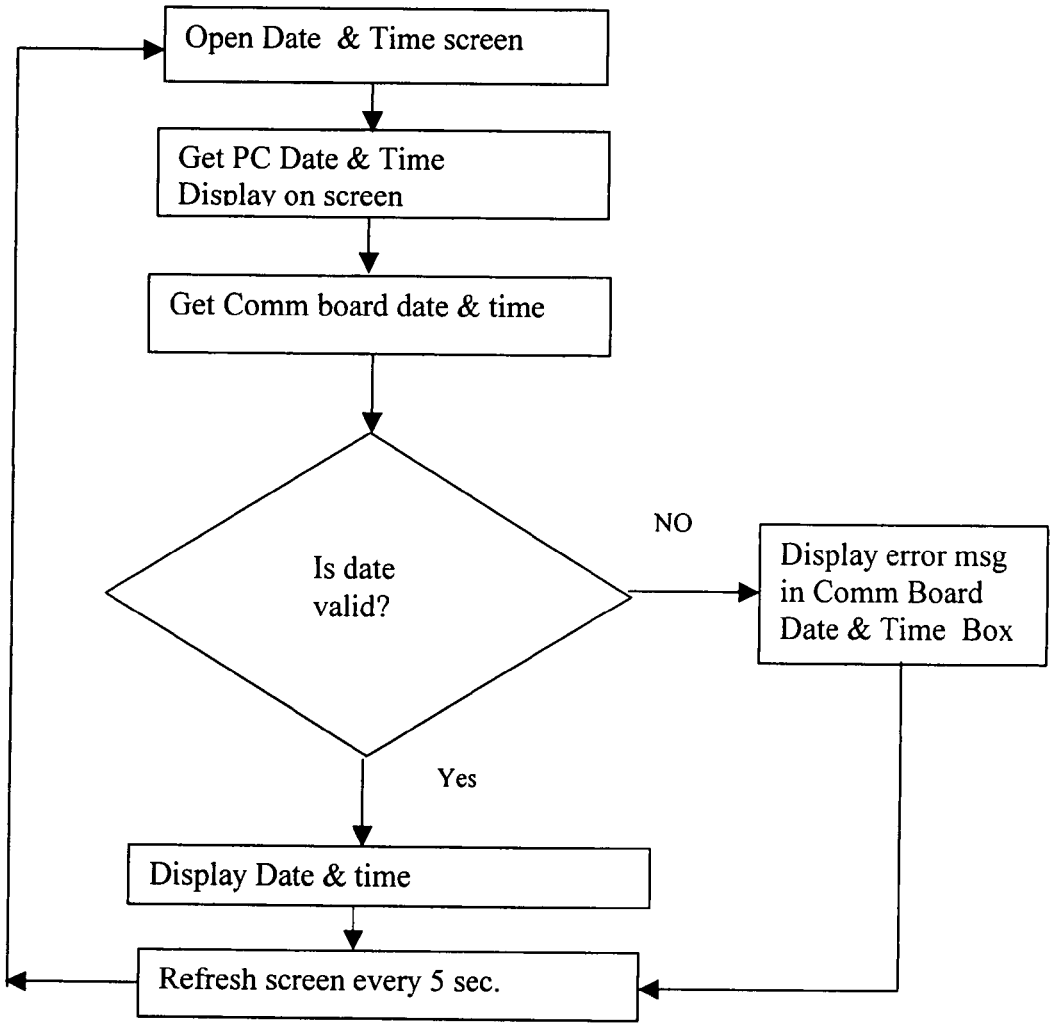
Figure 15K:
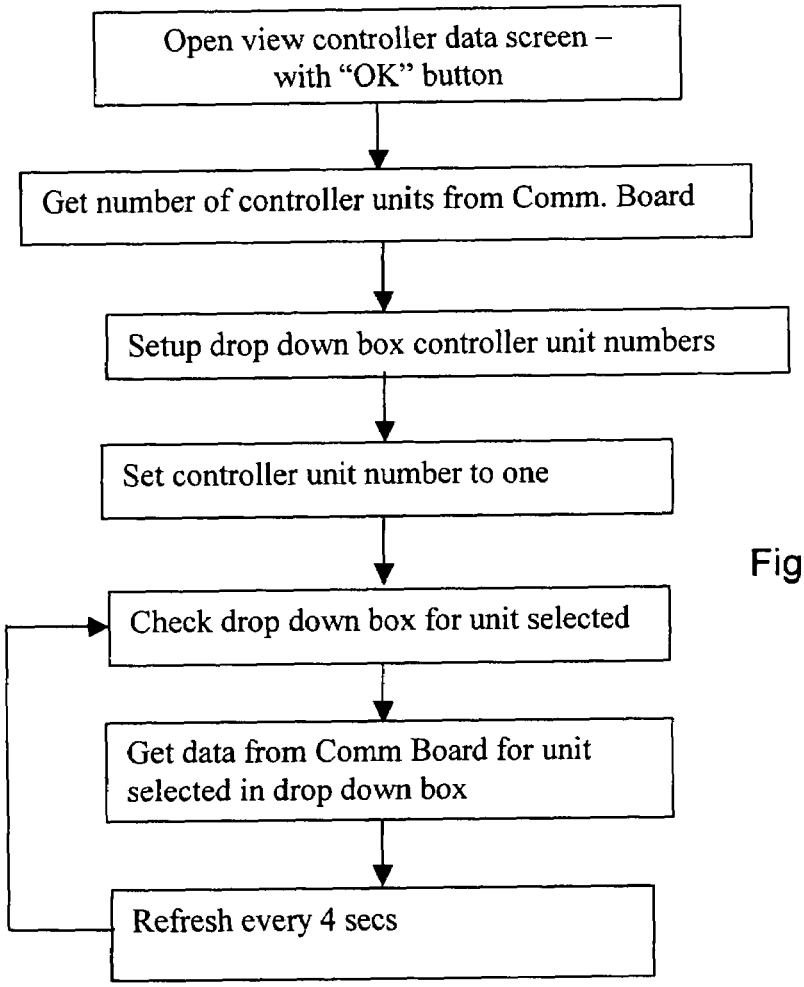
Figure 15L:
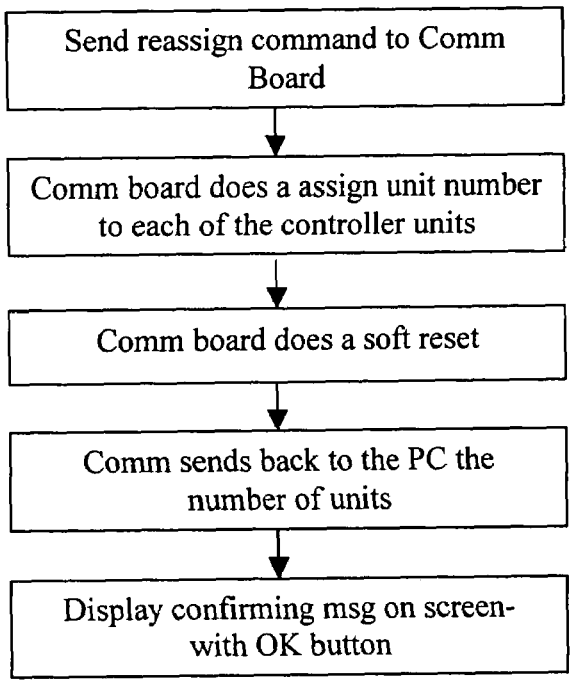
Figure 15M:
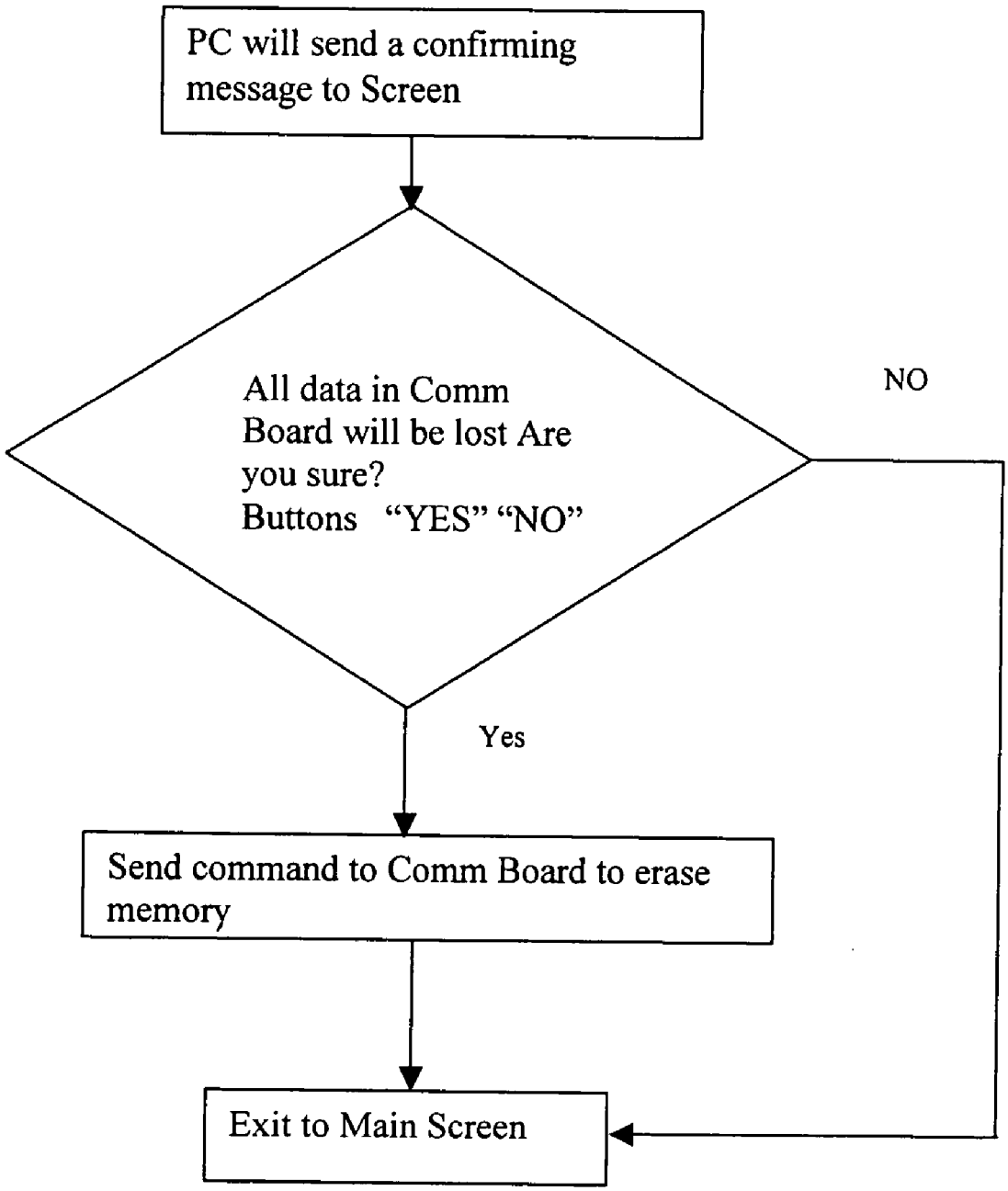
Figure 15N:
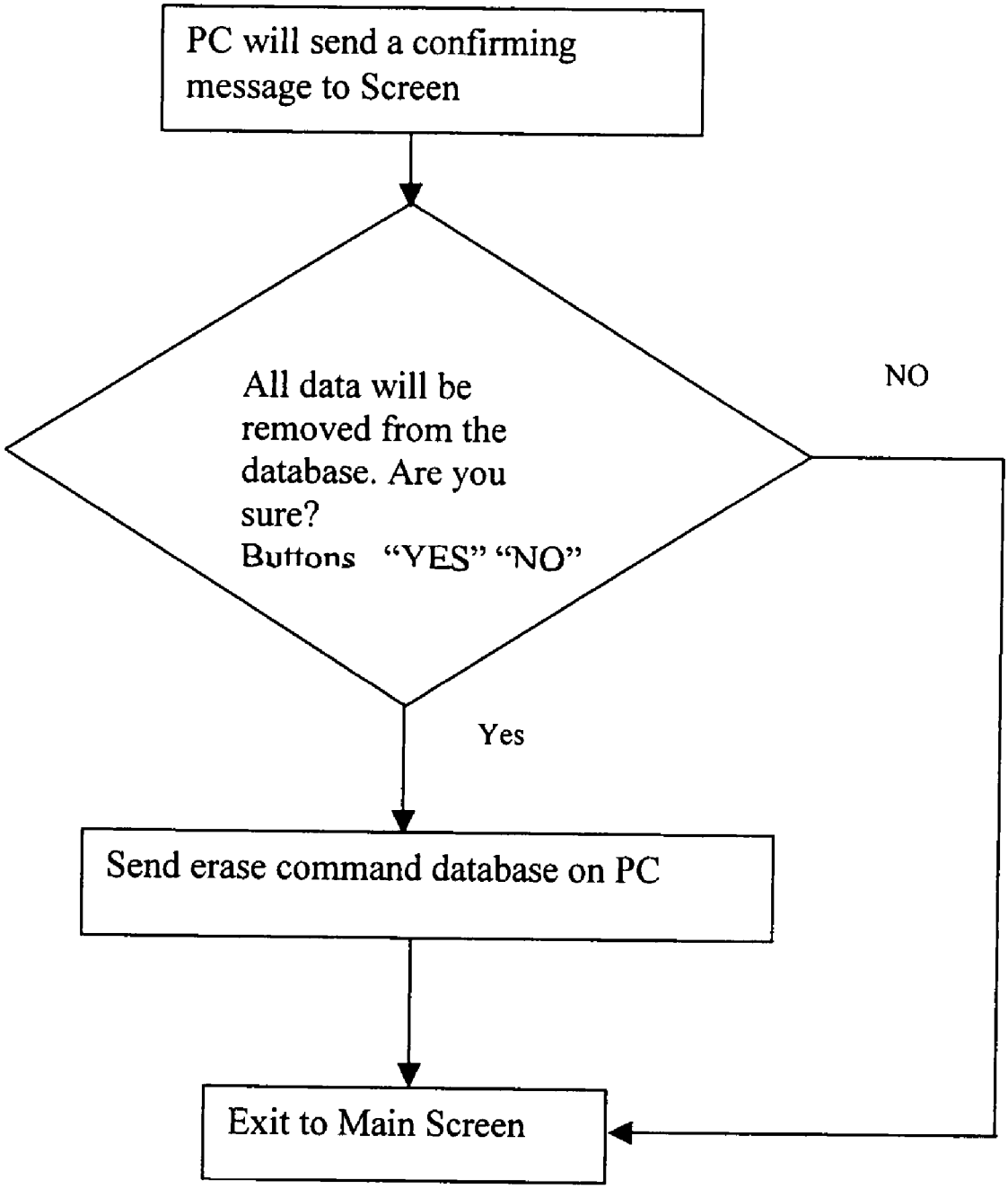
Figure 15O:
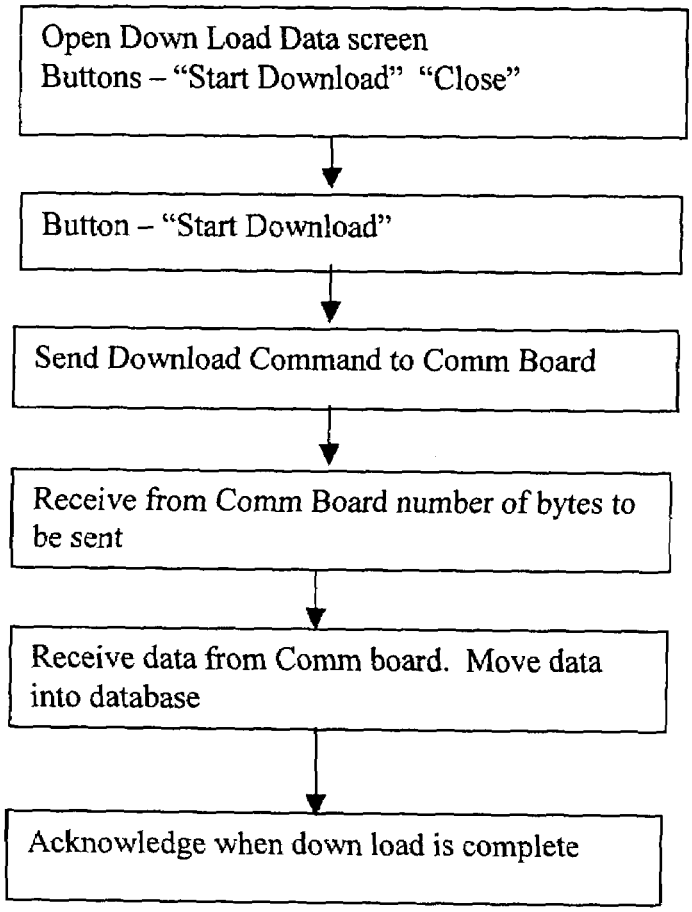
Figure 15P:
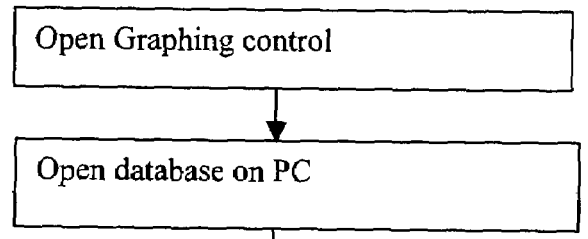
Figure 15Q:
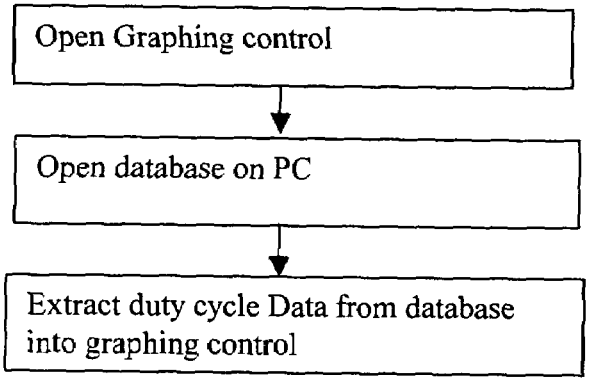

FIG. 13 illustrates the electronics utilized by the apparatus of this invention. Incoming AC power is provided to relay 43 and is transformed at input/transformer 41/45 (12 volt DC output) for use by controller unit 31 and sensors 33, 35 and 37. Sensors 33 and 35 inputs are A/D converted and input to the central processing unit microprocessor 53 embodying the various comparitors and look up tables utilized (Sensor 37 is A/D converted at the sensor). LED's 65/67 are controlled in response to microprocessor functions, and microprocessor programming can be conducted on-site through connector/interface 71. Communications flow between microprocessor 53 and central processing 59 is monitored and controlled by communications board 57 in cooperation with microprocessor 53 and central processing 59. Relay activity is monitored and controlled by microprocessor 53 in response to set point achievement as specified in software and as sensed by the sensor array.

Thermal isolation of sensors 35 and 37 thus insure the accuracy of the sensors and thus the efficacy of the apparatus both in terms of its ability to anticipate condensation formation as well as its ability to save on energy expenses due to overheating of doors and frames or improper cycling of heaters. Overall functioning of the apparatus and system of this invention are as illustrated in FIGS. 14*a* through 14*j* and 15*a* through 15*q*. Heaters are activated just above dew point and thus just before moisture appears on freezer surfaces. Controller unit 31 may utilize any known sensor(s) 37 for monitoring ambient air temperature (for example, thermistors may be utilized for the temperature sensors herein, including by sensors 33 and 35) and relative humidity (capacitive polymer or thin film type sensor, for example, may be utilized wherein capacitance is proportional to the relative humidity of surrounding air). Combination sensors providing relatively accurate dew point sensing are known and commercially available. Microprocessor 53 looks up the dew point value from a stored table. Input from monitored dew point sensor 37 and frame temperature sensor 35 are utilized in conjunction therewith to determine when to relay on the frame/door heaters as the frame temperature approaches the dew point (once the monitored frame temperature drops below a preselected set point above the dew point). Once the monitored frame temperature rises to a preselected set point above the dew point, the heaters are relayed off. On-board software builds a table of over 600 values into the dew point lookup table, set points, as well as other values, being updatable in real time from central processing. The look up table can be reprogrammed through interface 71.

The entire system preferably includes wireless communication for receiving data from multiple control units 31 at different cases 21. Controller unit 31 and communications board/transmitter/receiver 59 transfer data to central processing 59 for data viewing, tracking and report preparation. Central processing 59 is capable of printing efficiency reports, remote recalibration of heater operations and dial up warning programs should any freezer have a failure. Each controller unit 31 tracks internal case temperatures and will warn of unsafe temperatures or freezer failure. Unit/system calibration or recalibration is typically only required when sensors might be influenced by freezer temperatures. Freezer temperatures primarily influence sensor readings dependent on where sensors are mounted at installation. The case frame is not as cold at the top of the freezer as the bottom, so the operating range of the sensors and unit 31 in the combined sensor housing configuration of FIG. 10 are calibrated for the alternative locations.

What is claimed is:

1. A method for condensation control at a refrigerated display case having at least one door, a frame and at least one frame/door heater, said method comprising the steps of:

monitoring case frame temperature and providing first output data related thereto;

monitoring ambient air temperature and relative humidity outside the display case and providing second output data related thereto;

processing said first and second output data at said display case to anticipate formation of condensation at the display case and activating and deactivating the frame/door heater responsive thereto; and communicating said first and second output data related to monitored case frame temperature, ambient air temperature and relative humidity and a record of display case frame/door heater activation and deactivation to a remote centralized processing location.

2. The method of claim 1 wherein said communicating step includes wirelessly receiving said first and second output data and said record from a selected one of a plurality of refrigerated display cases and wirelessly communicating with said processing location.

3. The method of claim 1 wherein said monitoring steps include reducing data inaccuracy by thermally isolating units utilized for monitoring.

4. The method of claim 1 further comprising accumulating said data and said record at said processing location to provide at least one of selective data/record viewing and data/record reporting.

5. The method of claim 1 further comprising accumulating a history of said record of display case frame/door heater activation and deactivation and selectively compiling efficiency reports related thereto at said processing location.

6. The method of claim 1 further comprising remotely recalibrating frame/door heater activation or deactivation based on data acquisition.

7. The method of claim 1 further comprising establishing constantly updatable on-site automated control parameters for the step of processing said first and second output data to anticipate formation of condensation at the display case and activating and deactivating the frame/door heater.

8. A method for condensation control at a refrigerated display case having at least one door, a frame and at least one frame/door heater, said method comprising the steps of:

placing a temperature sensing unit in contact with the display case frame to monitor case frame temperature;

mounting a dew point sensing unit on the display case to monitor ambient air temperature and relative humidity outside the display case; and utilizing monitored case frame temperature, ambient air temperature and relative humidity to anticipate formation of condensation at the display case and activating and deactivating the frame/door heater responsive thereto.

9. The method of claim 8 further comprising thermally isolating said dew point sensing unit from variations in temperature of the display case frame or display case door.

10. The method of claim 8 further comprising thermally isolating said temperature sensing unit from variations in temperature of ambient air.

11. The method of claim 8 further comprising mounting an internal case temperature sensing unit inside the display case and monitoring internal case temperature.

12. The method of claim 11 further comprising storing data related to readings at said sensing units and operation of the frame/door heater.

13. The method of claim 12 further comprising wirelessly accessing said stored data.

14. A method for condensation control at any of a plurality of refrigerated display cases, each of the display cases having at least one door, a frame and at least one frame/door heater, said method comprising the steps of:

monitoring selected parameters related to each of the display cases in the plurality of display cases and providing output data related thereto;

collecting said output data;

anticipating from said collected output data condensation formation status at any of the display cases and establishing an output indicative thereof;

establishing measures to address said condensation formation status at any of the display cases responsive to said output indicative of condensation formation status; and compiling a record of said data and said measures.

15. The method of claim 14 wherein said monitoring step includes monitoring temperature of display case doors or display case frames of each of the display cases and monitoring dew point at each of the display cases by monitoring ambient air temperature and relative humidity outside of each of the display cases, and wherein said step of establishing measures to address said condensation formation status includes the step of activating a selected display case frame/door heater when monitored display case door or frame temperature drops below a preselected set point above a dew point value derived from monitored ambient temperature and relative humidity.

16. The method of claim 14 wherein said monitoring step includes monitoring temperature of display case doors or display case frames of each of the display cases and monitoring dew point at each of the display cases by monitoring ambient air temperature and relative humidity outside of each of the display cases, and wherein said step of establishing measures to address said condensation formation status includes the step of deactivating a selected display case frame/door heater when monitored display case door or frame temperature rises above a preselected set point above a dew point value derived from monitored ambient temperature and relative humidity.

17. The method of claim 14 further comprising the steps of monitoring internal case temperatures of said plurality of display cases and compiling a record thereof.

18. The method of claim 14 further comprising the step of communicating said record to a remote processing location.

19. The method of claim 14 further comprising the step of reducing output data inaccuracy by thermally isolating units utilized for monitoring.

20. The method of claim 14 further comprising the step of establishing constantly updatable automated control parameters for the steps of anticipating condensation formation status and establishing measures to address said condensation formation status at any of the display cases.

* * * * *